US010559291B2

(12) United States Patent
Woelfl

(10) Patent No.: US 10,559,291 B2
(45) Date of Patent: Feb. 11, 2020

(54) ARRANGEMENTS AND METHODS FOR GENERATING NATURAL DIRECTIONAL PINNA CUES

(71) Applicant: Harman Becker Automotive Systems GmbH, Karlsbad (DE)

(72) Inventor: Genaro Woelfl, Salching (DE)

(73) Assignee: Harman Becker Automative Systems GmbH, Karlsbad (DE)

( * ) Notice: Subject to any disclaimer, the term of this patent is extended or adjusted under 35 U.S.C. 154(b) by 0 days.

(21) Appl. No.: 15/860,489

(22) Filed: Jan. 2, 2018

(65) Prior Publication Data

US 2018/0192228 A1 Jul. 5, 2018

(30) Foreign Application Priority Data

Jan. 4, 2017 (EP) ..... 17150264

(51) Int. Cl.
*H04R 1/02* (2006.01)
*H04R 1/10* (2006.01)
(Continued)

(52) U.S. Cl.
CPC ..... *G10K 11/17815* (2018.01); *G10K 1/38* (2013.01); *G10K 11/17827* (2018.01);
(Continued)

(58) Field of Classification Search
CPC .... H04R 5/02; H04R 2205/022; H04R 5/033; H04R 1/028; H04R 1/1008; H04R 1/1083;
(Continued)

(56) References Cited

U.S. PATENT DOCUMENTS 5,033,086 A * 7/1991 Fidi ..... H04S 1/005 381/310
5,182,774 A 1/1993 Bourk
(Continued)

FOREIGN PATENT DOCUMENTS

CN 2678294 Y * 2/2005
EP 0589623 A2 3/1994
(Continued)

OTHER PUBLICATIONS

Woelfl, G. et al., "Systems and Methods for Generating Natural Directional Pinna Cues for Virtual Sound Source Synthesis," U.S. Appl. No. 15/860,451, filed Jan. 2, 2018, 120 pages.
(Continued)

*Primary Examiner* — Davetta W Goins
*Assistant Examiner* — Kuassi A Ganmavo
(74) *Attorney, Agent, or Firm* — McCoy Russell LLP

(57) ABSTRACT

A headphone arrangement is configured to induce natural directional pinna cues. The arrangement comprises an ear cup comprising a frame configured to at least partly encircle the ear of a user, wherein the frame is at least partially hollow. The arrangement further comprises a loudspeaker arranged within a wall of a frontal part, a rear part, an upper part, and/or a lower part of the frame, the loudspeaker comprising a membrane, a first side of the membrane facing a cavity inside the frame, and a second side of the membrane facing the outside. At least one loudspeaker is arranged at a first angle with respect to a median plane crossing a user's head midway between the user's ears such that a main direction of sound propagation is directed away from the median plane, and the second side of the membrane is directed away from the median plane.

15 Claims, 7 Drawing Sheets

(51) Int. Cl.

| | |
|---|---|
| ***H04S 3/00*** | (2006.01) |
| ***H04S 5/02*** | (2006.01) |
| ***H04R 5/04*** | (2006.01) |
| ***G10K 11/178*** | (2006.01) |
| ***G10K 1/38*** | (2006.01) |
| ***H04R 3/02*** | (2006.01) |
| ***H04R 5/02*** | (2006.01) |
| ***H04S 7/00*** | (2006.01) |
| ***H04R 5/033*** | (2006.01) |

(52) U.S. Cl.
CPC ..... *G10K 11/17881* (2018.01); *H04R 1/028* (2013.01); *H04R 1/1008* (2013.01); *H04R 1/1083* (2013.01); *H04R 3/02* (2013.01); *H04R 5/02* (2013.01); *H04R 5/033* (2013.01); *H04R 5/04* (2013.01); *H04S 3/008* (2013.01); *H04S 5/02* (2013.01); *H04S 7/304* (2013.01); *H04S 7/306* (2013.01); *G10K 11/178* (2013.01); *G10K 2210/1081* (2013.01); *G10K 2210/128* (2013.01); *G10K 2210/3026* (2013.01); *G10K 2210/3044* (2013.01); *G10K 2210/3046* (2013.01); *H04R 2205/022* (2013.01); *H04R 2460/01* (2013.01); *H04R 2499/13* (2013.01); *H04S 2400/01* (2013.01); *H04S 2400/11* (2013.01); *H04S 2420/01* (2013.01)

(58) Field of Classification Search
CPC ..... H04R 5/04; H04R 2499/13; H04S 3/008; H04S 35/02; H04S 7/306; H04S 2400/01; G10K 11/17815; G10K 11/17881; G10K 11/17827; G10K 11/178; G10K 2210/128
See application file for complete search history.

(56) References Cited

U.S. PATENT DOCUMENTS 5,497,427 A * 3/1996 Nageno ..... H04R 1/1066 381/381
6,038,330 A * 3/2000 Meucci, Jr. ..... H04R 1/1075 345/8
6,597,792 B1 * 7/2003 Sapiejewski ..... H04R 1/1083 381/371
9,596,544 B1 * 3/2017 Brotherton ..... H04R 5/02
2006/0204016 A1 * 9/2006 Pham ..... H04R 1/1075 381/74
2007/0025574 A1 * 2/2007 Azima ..... H04R 1/1075 381/330
2007/0098198 A1 * 5/2007 Hildebrandt ..... H04R 1/1075 381/370
2007/0156262 A1 * 7/2007 Craven ..... G05B 13/042 700/73
2007/0274548 A1 * 11/2007 Huang ..... H04R 1/1075 381/309
2007/0280484 A1 * 12/2007 Anderson ..... H04R 5/0335 381/17
2010/0195842 A1 * 8/2010 Sibbald ..... H04R 1/1083 381/71.6
2013/0129106 A1 * 5/2013 Sapiejewski ..... H04R 1/105 381/71.6
2013/0216074 A1 * 8/2013 Kon ..... H04R 5/02 381/310
2015/0055814 A1 * 2/2015 Liu ..... H04R 1/1075 381/373
2015/0117659 A1 * 4/2015 Kirsch ..... A61F 11/14 381/72

FOREIGN PATENT DOCUMENTS

EP 2611214 A1 7/2013
WO WO-2004040941 A1 * 5/2004 ..... H04R 1/1075

OTHER PUBLICATIONS

Woelfl, G., "Arrangements and Methods for 3D Audio Generation," U.S. Appl. No. 15/860,468, filed Jan. 2, 2018, 60 pages.
Woelfl, G. et al., "Arrangements and Methods for Active Noise Cancelling," U.S. Appl. No. 15/860,546, filed Jan. 2, 2018, 36 pages.
European Patent Office, Extended European Search Report Issued in Application No. 17209908.7, dated May 22, 2018, Germany, 11 pages.

* cited by examiner

ARRANGEMENTS AND METHODS FOR GENERATING NATURAL DIRECTIONAL PINNA CUES

CROSS REFERENCE TO RELATED APPLICATIONS

The present application claims priority to European Patent Application No. EP17150264.4 entitled "ARRANGEMENTS AND METHODS FOR GENERATING NATURAL DIRECTIONAL PINNA CUES", and filed on Jan. 4, 2017. The entire contents of the above-listed application are hereby incorporated by reference for all purposes.

TECHNICAL FIELD

The disclosure relates to arrangements and methods for controlled generation of natural directional pinna cues, in particular for improving the spatial representation of stereo as well as 2D and 3D surround sound content over headphones.

BACKGROUND

Most headphones available on the market today produce an in-head sound image when driven by a conventionally mixed stereo signal. "In-head sound image" in this context means that the predominant part of the sound image is perceived as originating inside the listeners head, usually on an axis between the ears. If sound is externalized by suitable signal processing methods (externalizing in this context means the manipulation of the spatial representation in a way such that the predominant part of the sound image is perceived as originating outside the listeners head), the center image tends to move mainly upwards instead of moving towards the front of the listener. While especially binaural techniques based on Head Related Transfer Function (HRTF) filtering are very effective in externalizing the sound image and even in positioning virtual sound sources on most positions around the listeners head, such techniques usually fail to position virtual sources correctly on a frontal part of the median plane (in front of the user). This means that neither the (phantom) center image of conventional stereo systems nor the center channel of common surround sound formats can be reproduced at the correct position when played over commercially available headphones, although those positions can be considered the most important positions for stereo and surround sound presentation.

SUMMARY

A headphone arrangement is configured to induce natural directional pinna cues. The arrangement comprises at least one ear cup comprising a frame that is configured to be arranged to at least partly encircle the ear of a user, thereby defining an open volume around the ear of the user, wherein the frame is at least partially hollow, thereby providing at least one cavity on its inside that is separated from the outside by at least one wall of the frame. The arrangement further comprises at least one loudspeaker arranged within a wall of at least one of a frontal part, a rear part, an upper part, and a lower part of the frame of the ear cup, wherein the at least one loudspeaker comprises a membrane and wherein a first side of the membrane faces a cavity inside the frame and a second side of the membrane faces the outside and wherein, when the at least one ear cup is arranged to encircle the ear of the user, at least one of the at least one loudspeaker is arranged at a first angle with respect to a median plane such that at least one of its main directions of sound propagation is directed away from the median plane, and the second side of the membrane is directed away from the median plane. The median plane crosses the user's head midway between the user's ears, thereby virtually dividing the head into an essentially mirror-symmetrical left half side and right half side.

Other systems, methods, features and advantages will be or will become apparent to one with skill in the art upon examination of the following detailed description and figures. It is intended that all such additional systems, methods, features and advantages be included within this description, be within the scope of the disclosure and be protected by the following claims.

BRIEF DESCRIPTION OF THE DRAWINGS

The method may be better understood with reference to the following description and drawings. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Most headphones available on the market today produce an in-head sound image when driven by a conventionally mixed stereo signal. "In-head sound image" in this context means that the predominant part of the sound image is perceived as originatingoriginating inside the user's head, usually on an axis between the ears (running through the left and the right ear, see axis x in FIG. 3). 5.1 surround sound systems usually use five speaker channels, namely front left and right channel, center channel and two surround rear channels. If a stereo or 5.1 speaker system is used instead of headphones, the phantom center image or center channel image is produced in front of the user. When using headphones, however, these center images are usually perceived in the middle of the axis between the user's ears.

Figure 3:
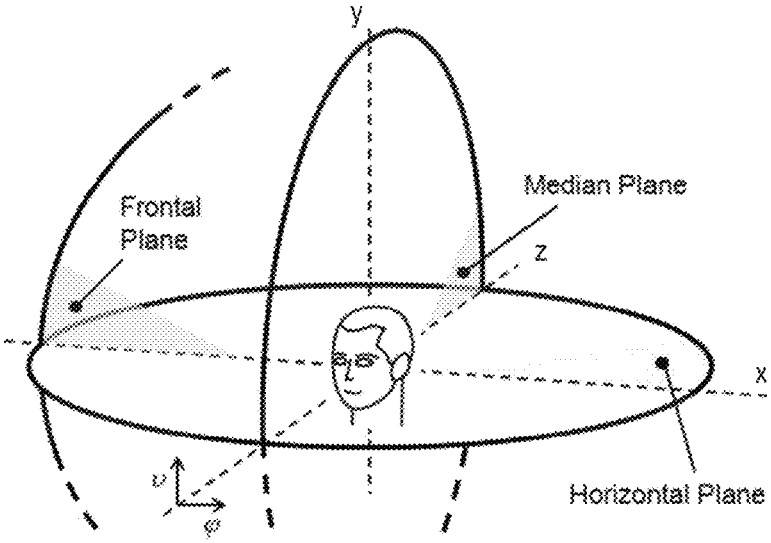
FIG. 3 schematically illustrates various planes and angles for source localization.

Sound source positions in the space surrounding the user can be described by means of an azimuth angle φ (position left to right), an elevation angle υ (position up and down) and a distance measure (distance of the sound source from the user). The azimuth and the elevation angle are usually sufficient to describe the direction of a sound source. The human auditory system uses several cues for sound source localization, including interaural time difference (ITD), interaural level difference (ILD), and pinna resonance and cancellation effects, that are all combined within the head related transfer function (HRTF). FIG. 3 illustrates the planes of source localization, namely a horizontal plane (also called transverse plane) which is generally parallel to the ground surface and which divides the user's head in an upper part and a lower part, a median plane (also called midsagittal plane) which is perpendicular to the horizontal plane and, therefore, to the ground surface and which crosses the user's head approximately midway between the user's ears, thereby dividing the head in a left half side and a right half side, and a frontal plane (also called coronal plane) which equally divides anterior aspects and posterior aspects and which lies at right angles to both the horizontal plane and the median plane. Azimuth angle φ and elevation angle υ are also illustrated in FIG. 3 as well as the three axes x, y, z. In this document, different headphone arrangements will be discussed, mostly with reference to a single ear (e.g., right ear). Headphones are usually designed identically for both ears with respect to acoustical characteristics and are placed on both ears in a virtually similar position relative to the respective ear. A first axis x runs through the ears of the user 2. In the following, it will be assumed that the first axis x crosses the concha of the user's ear. The first axis is parallel to the frontal plane and the horizontal plane, and perpendicular to the median plane. A second axis y runs vertically through the user's head, perpendicular to the first axis x. The second axis y is parallel to the median plane and the frontal plane, and perpendicular to the horizontal plane. A third axis z runs horizontally through the user's head (from front to back), perpendicular to the first axis x and the second axis y. The third axis z is parallel to the median plane and the horizontal plane, and perpendicular to the frontal plane. The position of the different planes x, y, z will be described in greater detail below.

Figure 1A:
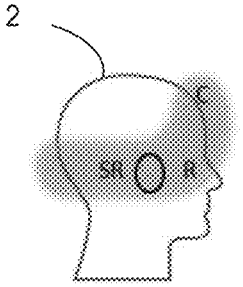
FIGS. 1A and 1B schematically illustrate a typical path of virtual sources positioned around a user's head.
Figure 1B:
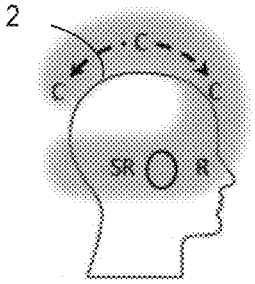

If sound in conventional headphone arrangements is externalized by suitable signal processing methods (externalizing in this context means that at least the predominant part of the sound image is perceived as originating outside the user's head), the center channel image tends to move mainly upwards instead of to the front. This is exemplarily illustrated in FIG. 1A, wherein SR identifies the surround rear image location, R identifies the front right image location and C identifies the center channel image location. Virtual sound sources may, for example, be located somewhere on and travel along the path of possible source locations, as is indicated in FIG. 1A, if the azimuth angle φ (see FIG. 3) is incrementally shifted from 0° to 360° for binaural synthesis, based on generalized head related transfer functions (HRTF) from the horizontal plane. While especially binaural techniques based on HRTF filtering are very effective in externalizing the sound image and even in positioning virtual sound sources on most positions around the user's head, such techniques usually fail to position sources correctly on a frontal part of the median plane. A further problem that may occur is the so-called front-back confusion, as is illustrated in FIG. 1B. Front-back confusion means that the user 2 is not able to locate the image reliably in front of his head, but somewhere above or even behind his head. This means that neither the center sound image of conventional stereo systems nor the center channel sound image of common surround sound formats can be reproduced at the correct position when played over commercially available headphones, although those positions are the most important positions for stereo and surround sound presentation.

Sound sources that are arranged in the median plane (azimuth angle φ=0°) lack interaural differences in time (ITD) and level (ILD) which could be used to position virtual sources. If a sound source is located on the median plane, the distance between the sound source and the ear as well as the shading of the ear through the head are the same to both the right ear and the left ear. Therefore, the time the sound needs to travel from the sound source to the right ear is the same as the time the sound needs to travel from the sound source to the left ear and the amplitude response alteration caused by the shading of the ear through parts of the head is also equal for both ears. The human auditory system analyzes cancellation and resonance magnification effects that are produced by the pinnae, referred to as pinna resonances in the following, to determine the elevation angle on the median plane. Each source elevation angle and each pinna generally provokes very specific and distinct pinna resonances.

Pinna resonances may be applied to a signal by means of filters derived from HRTF measurements. However, attempts to apply foreign (e.g., from another human individual), generalized (e.g., averaged over a representative group of individuals), or simplified HRTF filters usually fail to deliver a stable location of the source in the front, due to strong deviations between the individual pinnae. Only individual HRTF filters are usually able to generate stable frontal images on the median plane if applied in combination with individual headphone equalizing. However, such a degree of individualization of signal processing is almost impossible for consumer mass market.

Figure 2:
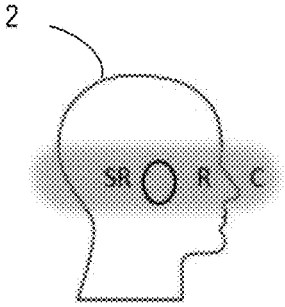
FIG. 2 schematically illustrates a possible path of virtual sources positioned around a user's head.

The present disclosure includes headphone arrangements that are capable of generating strong directional pinna cues for the frontal hemisphere in front of a user's head 2 and/or appropriate cues for the rear hemisphere behind the user's head 2. Some of the proposed headphone arrangements support the generation of an improved centered frontal sound image and embodiments of the disclosure are further capable of positioning virtual sound sources all around the user's head 2 if combined with appropriate signal processing. This is exemplarily illustrated in FIG. 2, where the center channel image C is located at a desired position in front of the user's head 2. If directional pinna cues associated with the frontal and rear hemisphere are available and can be individually controlled, for example if they are produced by separate loudspeakers, it is possible to position virtual sources all around the user's head if, in addition, suitable signal processing is applied. Additionally, directional pinna cues from above and below the user 2 may be induced to improve the placement of the virtual sources in the respective hemisphere.

The spatial characteristics of headphones are usually less important than general sound quality attributes such as tonal balance, a wide working frequency range and low distortion. If the general sound quality is inferior to typical headphone standards, spatial effects are usually rejected by users, especially for stereo playback. Therefore, a fundamental characteristic of the proposed headphone arrangement is that the arrangement is not substantially worse in general sound quality aspects than typical headphones that are available today. Especially the playback of low frequencies usually requires physical structures of considerable size to be positioned around the user's ear. The reduction of negative effects of such structures on the controlled induction of natural directional pinna cues is one of the main aspects of the proposed headphone arrangement. Controlled induction of natural directional pinna cues can serve multiple purposes. As has been described before, the localization accuracy of virtual sources on the median plane can be improved by inducing suitable directional pinna cues. Another advantage over conventional binaural synthesis based on generalized HRTFs is the improved tonality, because the user is presented with his own spectral shape cues which are, in contrast to foreign spectral shape cues, not perceived as disturbing tonality alterations. On the other hand, directional pinna cues may also be suppressed in a controlled way by superposition of multiple essentially contradicting directional cues as provided by some of the proposed headphone arrangements. This provides an ideal basis for conventional binaural synthesis based on generalized or individual HRTFs, because no disturbing directional pinna cues are generated by the headphone arrangement. Conventional binaural synthesis that is based on generalized or individual HRTFs is currently the de facto standard for virtual and augmented reality applications which often only provide a binaural (2 channel) signal. Therefore, compatibility to this format is an important feature that is supported by some of the proposed headphone arrangements. Finally, even normal stereo playback without any spatial processing may benefit from headphone arrangements that do not produce uncontrolled comb filtering effects which may result from reflections inside a headphone structure and disturb the tonality of reproduced sound. In addition to improved spatial imaging and tonality, the proposed headphone arrangement is particularly well suited for augmented reality applications, for example, because the natural sound field reaches the ear of the user virtually unaltered. Furthermore, the proposed headphone arrangement solves problems of conventional headphones such as unwanted pressure on the ears or heat built up inside the ear cups, for example.

In this document, the terms pinna cues and pinna resonances are used to denominate the frequency and phase response alterations imposed by the pinna and possibly also the ear canal in response to the direction of arrival of the sound. The terms directional pinna cues and directional pinna resonances in this document have the same meaning as the terms pinna cues and pinna resonances, but are used to emphasize the directional aspect of the frequency and phase response alterations produced by the pinna. Furthermore, the terms natural pinna cues, natural directional pinna cues and natural pinna resonances are used to point out that these resonances are actually generated by the user's pinna in response to a sound field in contrast to signal processing that emulates the effects of the pinna. Generally, pinna resonances that carry distinct directional cues are excited if the pinna is subjected to a direct, approximately unidirectional sound field from the desired direction. This means that sound waves emanating from a source from a certain direction hit the pinna without the addition of previously reflected sounds of the same sound source from different directions. While humans are generally able to determine the direction of a sound source in the presence of typical previous room reflections, reflections that arrive within a too short of a time window after the direct sound will alter the perceived sound direction. Therefore, the headphone arrangement according to the present disclosure sends direct sound to the pinna while suppressing, or at least reducing, reflections from surfaces close to the pinna and, therefore, is able to induce strong directional cues.

Known stereo headphones generally can be grouped into in-ear, over-ear and around-ear types. Around-ear types are commonly available as so-called closed-back headphones with a closed back or as so-called open-back headphones with a ventilated back. Headphones may have a single or multiple drivers (loudspeakers). In addition to high quality in-ear headphones, specific multi-way surround sound headphones exist that utilize multiple loudspeakers with the aim of generating directional effects.

In-ear headphones are generally not able to generate natural pinna cues, due to the fact that the sound does not pass the pinna at all and is directly emitted into the ear canal. Within a fairly large frequency range, on-ear and around-ear headphones having a closed back produce a pressure chamber around the ear that usually either completely avoids pinna resonances or at least alters them in an unnatural way. In addition, this pressure chamber is directly coupled to the ear canal which alters ear canal resonances compared to an open sound-field, thereby further obscuring natural directional cues. At higher frequencies, elements of the ear cups reflect sound, whereby a partly diffuse sound field is produced that cannot induce pinna resonances associated with a single direction. The open headphone according to the present disclosure avoids such drawbacks. Headphones with a closed ear cup forming an essentially closed chamber around the ear, however, also provide several advantages, e.g., with regard to loudspeaker sensitivity and frequency response extension. Therefore, a cover may be provided for an open headphone. The cover may be configured to be separably mountable/attachable to the open headphone construction to provide a closed headphone in situations in which a closed headphone is preferred by the user. This allows the user to choose between an open or closed headphone based on his present preference. To this end, the process of mounting and detaching the cover may be kept simple in order to not require the use of any tool by the user to mount and/or detach the cover. The headphone may include a detection unit that is configured to detect whether the cover is mounted/attached to the headphone or not. When it is detected that the cover is mounted/attached to the headphone, which means that an essentially closed chamber is provided around the ear, the equalizing may be adapted automatically (e.g., by means of an adaption unit) to compensate for the amplitude response differences between an open and a closed ear cup.

Figure 21A:
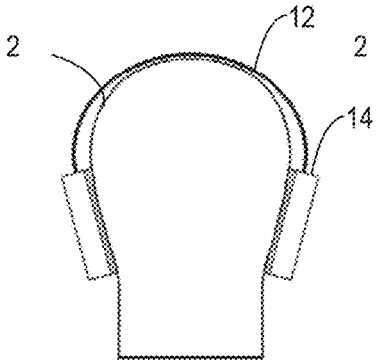
FIGS. 21A and 21B schematically illustrate open and closed headphone arrangements.
Figure 21B:
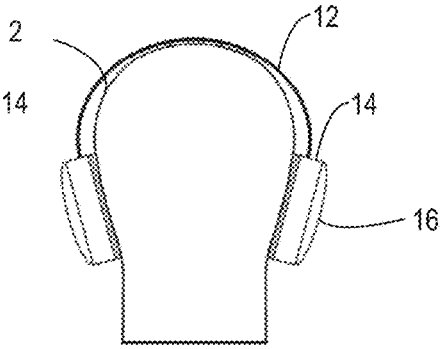

Such a headphone arrangement is illustrated in FIGS. 21A and 21B, for example. FIG. 21A schematically illustrates an open headphone arrangement 10, whereas FIG. 21B illustrates the headphone arrangement 10 of FIG. 21A as a closed headphone arrangement. The headphone arrangement 10 comprises at least one ear cup 14 that is configured to be arranged around the ear of the user. One ear cup 14 may be provided for each ear. The ear cups 14 may be held together by an over-the-head headband 12. This is, however, only an example. The ear cups 14 may be held together in any other suitable way. A cover 16 may be separably mounted/attached on each ear cup 14 to obtain a closed ear cup headphone arrangement 10. The cover 16 can be removed from the ear cup 14 to obtain an open ear cup headphone arrangement 10. The cover 16 may be separably mounted/attached on the ear cup 14 in any suitable way, e.g. using brackets, magnets, or clamps. The arrangement in FIGS. 21A and 21B further illustrates cushions between the ear cups and the user's head as well as a head band 12 to hold the ear cups in place.

Typical open-back headphones as well as most closed-back around-ear and on-ear headphones that are available on the market today utilize large diameter loudspeakers. Such large diameter loudspeakers are often almost as big as the pinna itself, thereby producing a large plane sound wave at the side of the head, which is not suitable for generating consistent pinna resonances like those that would result from a directional sound field in front of the head. Additionally, the relatively large size of such loudspeakers as compared to the pinna, as well as the close distance between the loudspeaker and the pinna and the large reflective surface of such loudspeakers, result in an acoustic situation which resembles a pressure chamber for low to medium frequencies and a reflective environment for high frequencies. Both situations are detrimental to the induction of natural directional pinna cues associated with a single direction.

Surround sound headphones with multiple loudspeakers usually combine loudspeaker positions on the side of the pinna with a pressure chamber effect and reflective environments. Such headphones are usually not able to generate consistent directional pinna cues, especially not for the frontal hemisphere.

Generally all kinds of objects that cover the pinna, such as back covers of headphones or large loudspeakers themselves, may cause multiple reflections within the chamber around the ear generating a partly diffused sound field that is detrimental for natural pinna effects caused by directional sound fields.

Therefore, the present disclosure provides an optimized headphone arrangement that allows to send direct sound towards the pinna from all desired directions while minimizing reflections, in particular reflections from the headphone arrangement. While pinna resonances are widely accepted to be effective above frequencies of about 2 kHz, real world loudspeakers usually produce various kinds of noise and distortions that will allow the localization of the loudspeaker even for substantially lower frequencies. The user may also notice differences in distortion, temporal characteristics (e.g., decay time) and directivity between different speakers used within the frequency spectrum of the human voice. Therefore, a lower frequency limit in the order of about 200 Hz or lower may be chosen for the loudspeakers that are used to induce directional cues with natural pinna resonances, while reflections may be controlled at least for higher frequencies (e.g., above 2-4 kHz).

Generating a stable frontal image on the median plane presents the presumably biggest challenge compared to generating a stable image from other directions. Generally the generation of individual directional pinna cues is more important for the frontal hemisphere (in front of the user) than for the rear hemisphere (behind the user). Effective natural directional pinna cues, however, are easier to induce for the rear hemisphere for which the replacement with generalized cues is generally possible with good effects, at least for standard headphones which place loudspeakers at the side of the pinna. Therefore, some of the proposed headphone arrangements focus on optimization of frontal hemisphere cues while providing weaker, but still adequate, directional cues for the rear hemisphere. Other arrangements may provide equally good directional cues for both the front and rear directions. To achieve strong natural directional pinna cues, the headphone arrangements are configured such that the sound waves emanated by one or more loudspeakers mainly pass the pinna, or at least the concha, once from the desired direction and with reduced energy in possible reflections that occur from other directions. Some arrangements focus on the reduction of reflections for loudspeakers in the frontal part of the ear cups, while other arrangements minimize reflections independent from the position of the loudspeaker. The present disclosure generally avoids putting the ear into a pressure chamber, for frequencies of at least above 2 kHz, or generating excessive reflections which tend to cause a partly diffuse sound field. To avoid reflections, the at least one loudspeaker may be positioned on the ear cup such that it results in the desired direction of the sound field. The support structure or headband and the back volume of the ear cup are arranged such that reflections are avoided or minimized.

Figure 7:
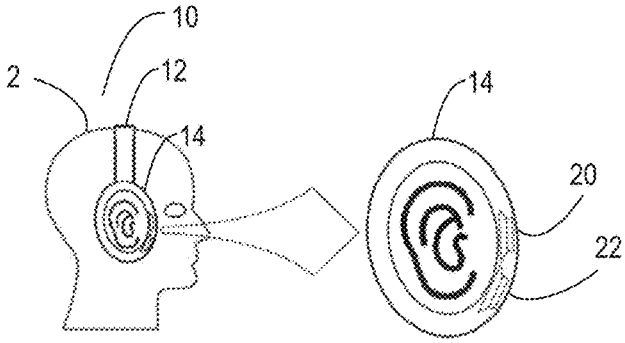
FIG. 7 schematically illustrates a headphone arrangement.

One example of a headphone arrangement 10 is illustrated in FIG. 7. The headphone arrangement 10 includes at least one ear cup 14 and a headband 12. The ear cup 14 comprises a frame that is configured to form an open structure around the ear. The frame of the ear cup 14 may be arranged to essentially encircle the ear of the user 2. The frame may be a continuous frame that completely encircles the ear without any interruptions. The frame, however, may also be a broken frame, meaning that it includes at least one interruption in its circumference. The frame may define an open volume around the ear of the user when the headphone arrangement is worn by the user. In particular the open volume may be essentially open to a side that faces away from the head of the user. The open volume, therefore, may comprise each point in space that can be intersected at least by one straight line between two points on the external surface of the frame without the straight line crossing any part of the frame. The headband 12 is configured to hold the ear cup 14 in place around the ear of the user. At least one loudspeaker 20 is arranged along the frame of the ear cup 14. The frame of the ear cup 14 may be at least partially hollow. One or more walls may separate one or more cavities inside the frame from the surrounding air on the outside. The at least one loudspeaker may comprise a membrane. The at least one loudspeaker 20 may be arranged in the wall of the frame of the ear cup 14 such that a first side of the membrane faces the outside and a second side of the membrane faces one of the at least one cavities inside the frame. In this way the one or more cavities provide a back volume for the at least one loudspeaker 20. The at least one loudspeaker 20 is configured to emit sound to the ear from a desired direction (e.g., from the front). The at least one loudspeaker 20 may be positioned on the frontal half of the ear cup 14 to support the creation of a sound image in the frontal hemisphere. Low frequency loudspeakers (not illustrated in FIG. 7), for example, may be arranged behind the ear on the rear half of the ear cup 14 to supplement the loudspeakers 20 that are arranged on the frontal half of the ear cup 14. When arranging the at least one loudspeaker 20 on the frontal half of the ear cup 14, the angle of the sound direction from the loudspeaker position to the concha area with respect to a horizontal plane through the ear canal does not necessarily have to match the elevation angle $\upsilon$ of the resulting sound image.

Figure 4:
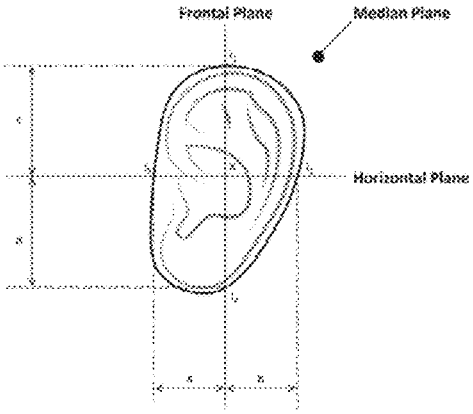
FIG. 4 schematically illustrates various planes corresponding to the planes of source localization in relation to the inner contour of an ear cup.
Figure 5:
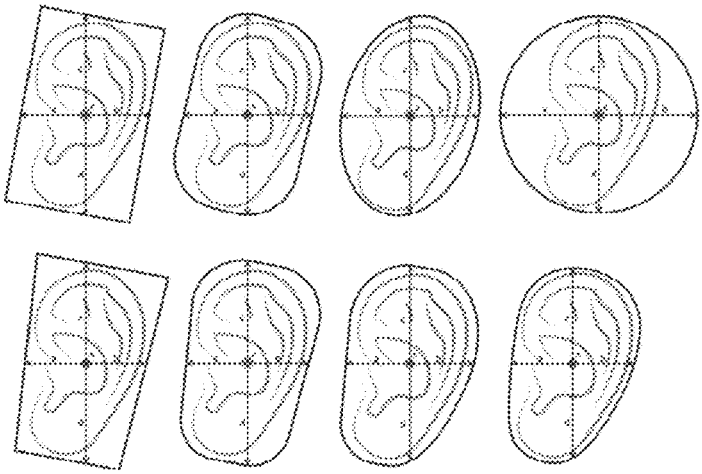
FIG. 5 schematically illustrates examples for different shapes of inner ear cup contours in relation to the intersection axis of a horizontal and a frontal plane.

The geometrical features of the ear cup 14 may be referenced to horizontal and frontal planes. The planes may generally correspond to the planes that have been described with reference to FIG. 3 before. However, for the purpose of a more detailed geometrical definition of the ear cup, the position of the corresponding horizontal and frontal planes may be defined geometrically in relation to specific geometric features of the ear cup. Referring to FIG. 5, it is assumed and exemplarily demonstrated that the planes described with respect to FIG. 3 essentially match the corresponding planes that will be described in the following with respect to the ear cup geometry when the ear cup is worn by a user. The geometrical dependencies that are illustrated in FIG. 4 position the first axis x, and thereby also a horizontal plane and a frontal plane, relative to geometrical features of the inner contour of the ear cup. The method of referencing as described with respect to FIG. 4 is, for example, suitable for continuous ear cup frames which completely encircle the ear. In such cases where the ear cup frame is a broken frame (non-continuous frame including at least one interruption, gap or recess within its circumference), the gap or recess within the projected inner contour outline (projected perpendicular onto the median plane) may be bridged by a line which interpolates the points between the ends of the projected contour line on both sides of the gap or recess if the gap or recess only spans a small fraction of the complete circumference of the ear cup. The reference system illustrated in FIG. 4, however, merely serves the purpose of defining the geometrical dependency between the ear cup frame construction and the horizontal and frontal planes, as referred to in this document in describing the ear cup construction details. This does not imply any direct relation between loudspeaker placement and/or orientation and perceived sound source location of the user. As is illustrated in FIG. 4, as well as in FIG. 3, the horizontal plane and the frontal plane intersect at the first axis x which is perpendicular to the median plane and, therefore, also perpendicular to the image plane of FIG. 4. In the following, the perpendicular projection of the inner contour outline of the frame of the ear cup onto the median plane, as well as the intersections between the contour projection and the frontal and the horizontal plane in the median plane, $i_1$-$i_4$ in FIG. 4, are utilized to define the position of the first axis x within and with respect to the inner contour outline of the ear cup frame.

For the projection of the inner contour outline of the ear cup frame onto the median plane, a typical wearing position of the ear cup on a user's head around the user's auricle may be assumed, with the user's head oriented as illustrated in FIG. 3 (user facing the origin of the azimuth and elevation angles $\upsilon$, $\varphi$, the azimuth and elevation angles $\upsilon$, $\varphi$ being zero). This may be seen as the typical wearing position which defines the rotation of the projection of the inner ear cup contour outline in the median plane and around the first axis x. The typical wearing position may, for example, depend on the specific inner contour outline of the ear cup or, in other words, on how the inner contour outline of the ear cup is typically positioned on or around the auricle. This typical position may implicitly be defined by the inner contour shape of the ear cup (e.g., the contour follows typical external auricle contours to some extent like, for example, oval, rectangular or elongated hole shapes), or, if no preferential positioning of the ear cup on the ear is implied by the internal ear cup contour (e.g., a circular or quadratic inner contour), any support structure that is used to position the ear cups on the user's ears (e.g., a headband or neck band) may still define a typical orientation of the ear cups with respect to the user's ears. The typical wearing position, which usually depends on the previously described features of the ear cup and/or of the complete headphone, may nevertheless vary for individual users. Especially the rotation of the ear cup parallel to the median plane may differ for individual users. However, these variations are negligible in their impact on the position of the first axis x with respect to the individual user's ear when the latter is constructed according to the following method.

As is illustrated in FIG. 4, the horizontal plane crosses the projected inner contour outline of the exemplary ear cup twice, once in front of the auricle sketch on the median plane ($i_1$) and once behind the auricle sketch ($i_2$). The frontal plane, which runs vertically through the contour projection on the median plane, also crosses the contour line twice—once above the auricle sketch on the median plane ($i_3$) and once below the auricle sketch ($i_4$). The horizontal plane and the frontal plane intersect at the first axis x. The point at which the first axis x intersects the median plane divides the straight lines between the upper and the lower intersection of the frontal plane with the inner contour line projection ($i_3$ and $i_4$) and between the frontal and the rear intersection of the horizontal plane with the inner contour line projection ($i_1$ and $i_2$) into four line segments with the lengths a, b, c and d. The position of the first axis x with respect to the inner contour line may be expressed as the ratio between a and b (horizontal ratio $r_h$=a/b) as well as the ratio between c and d (vertical ratio $r_v$=c/d). These ratios may, for example, be derived from average auricle dimensions of a statistically significant sample of individuals from a target user group such that for the average auricle the first axis x crosses the desired part of the auricle (e.g., the concha) at a desired position. Typical values for the horizontal ration m may be between 0.7 and 1.5, and typical values for the vertical ratio $r_v$ may be between 0.9 and 1.2. In the case of such values of the horizontal ratio and the vertical ratio, the first axis usually passes through the concha region.

If the ear cup comprises a broken frame and the gap or recess of the broken frame spans a large part of the complete circumference of the ear (e.g., more than 20% of the total circumference), the length c may be chosen to be between about 28 mm and 33 mm if the ear cup encircles an upper part of the ear, or the length d may be chosen to be between about 28 mm and 33 mm if the ear cup encircles a lower part of the ear. The contour line may also be extrapolated vertically if it does not reach a point in front of or behind the ear where the vertical distance to the highest or lowest point in the contour line is 28 mm-33 mm. The first axis x may be determined by the vertical distance c to the highest point of the projected inner contour outline of the ear cup or the vertical distance d to the lowest point of the projected inner contour line of the ear cup, and by the ratio between the distances a and b (between 0.7 and 1.5, e.g., 1). As described before, the horizontal distances a and b represent the distance between the intersection of the first axis x with the median plane and the intersection of the horizontal plane with the frontal (a), respectively rear (b) part of the projected inner contour line.

FIG. 5 schematically illustrates examples of inner ear cup contour outline shapes as projected on the median plane. The horizontal ratio m between a and b as well as the vertical ratio $r_v$ between c and d is $r_h=r_v=1$ for all inner contour line projection examples of FIG. 5. In the illustrated example, for such contour shapes which have two or more symmetry axes (e.g., top row of FIG. 5), the point where the first axis x intersects the projected contour shape (here: $r_h=r_v=1$) is identical with the geometric center of that shape. For contour shapes that are only symmetrical with respect to a single symmetry axis or completely asymmetric (e.g., bottom row of FIG. 5), the point where the first axis x intersects the contour shape may differ to various, but for reasonable contour shapes usually minor, extents from the geometric center of the shape. As can be seen on the auricle sketch shown for every inner contour line shape in FIG. 5, the point where the first axis x intersects an auricle may only vary slightly for different inner contour line shapes which at least loosely follow typical outer auricle contours, and typically falls into the concha region of the auricle. Obviously, inner ear cup contour shapes may be designed for which the point where the first axis x typically intersects an auricle differs substantially from the examples given in FIG. 5, with the given ratios $r_h=r_v=1$. However, such shapes usually look strange on a user's ear, as the fitting of the ear cup around the ear is visually exposed for an open ear cup and largely asymmetric distances between the ear and the inner ear cup contour are visually not appealing, as the ear cup looks misaligned with the ear and also results in oversized ear cup frames, which may also not be desirable. For individual users different auricle shapes and ear cup positions around the auricle will vary the actual point where the first axis x, as positioned within the ear cup by $r_h$ and $r_v$, intersects with the auricle. These variations usually cannot be avoided and the ear cups may therefore be designed for an average auricle shape and size in accordance with the target user group, which may result in acceptable variations for most users.

Figure 6:
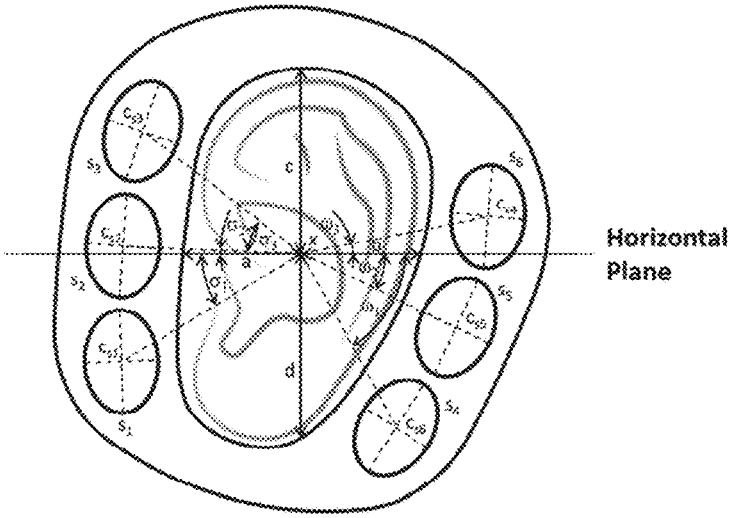
FIG. 6 schematically illustrates an example of an ear cup with loudspeakers and their angular relation to a horizontal plane.

The first axis x, positioned within the inner ear cup contour as described above, may be used to define geometrical loudspeaker position aspects with respect to the horizontal and vertical planes (e.g., position above, below, in front or behind a respective plane). As is exemplary illustrated in FIG. 6, the perpendicular projection onto the median plane of any straight line between the acoustic or geometric center (e.g., $c_{s1}$) of a loudspeaker or loudspeaker membrane (e.g., $s_1$) on an exemplary open ear cup frame and a point on the first axis x, has the same angular relation to the horizontal plane (e.g., $\sigma_1$). This angle relates to the elevation angle as illustrated in FIG. 3 and affects the perceived elevation angle for the user of the headphone arrangement although it should be noted that it is not necessarily identical to the perceived source elevation angle of the user. As natural directional pinna cues are particularly suited for controlling the perceived sound image elevation within the median plane, this angular relation to the horizontal plane will be used in the following to describe loudspeaker positioning within the frame of the ear cup.

There are several parameters that can alter directional pinna cues or the perceived source location associated with the pinna cues by the user. These parameters include the individual perception characteristics of the user which may lead to variations of the perceived image elevation angle, and reflections on parts of the headphone arrangement. As is illustrated in FIG. 7, a first loudspeaker 20 may be arranged in front of the user's ear such that part of the sound it emanates is directed essentially parallel to the horizontal plane towards the first axis x. A second loudspeaker 22 may be arranged below the first loudspeaker 20 such that it emanates at least part of its radiated sound towards the first axis x at an angle of about 10° to 30° with respect to the horizontal plane. Generally, individual directional pinna resonance cues from the front support and improve the generation of sound images in the frontal hemisphere of the user and thereby also the generation of sound images at a centered position in front of the user, even if the incidence angle at which the loudspeaker 22 is positioned does not exactly match the elevation angle of the desired sound image.

In FIG. 7, the frame of the ear cup 14 is continuous and has an oval shape. The oval shape, however, is only an example. Generally, the ear cup 14 may have any suitable form, e.g., circular, rectangular or any other regular or irregular form. The form of the ear cup 14 in combination with the loudspeaker arrangement may be chosen such that reflections of the sound on the sides of the ear cup 14 opposite to the loudspeakers are reduced. The form of the ear cup 14 may be chosen such that the pinna is kept essentially open and such that it allows the loudspeakers 20, 22 to be positioned at effective angles with respect to the horizontal plane to obtain the desired sound direction. However, there are usually constraints when choosing an optimum shape of the ear cups 14. The desired target sound field is unidirectional, meaning that reflections are altogether avoided. If a direct sound emanated from the front part of the ear cup 14 is accompanied by a reflection from above or behind the pinna, a directional cue may be weakened or be destroyed altogether. The more or the stronger the reflections, the less clear directional pinna cues will be induced. Therefore, the present disclosure aims to reduce the reflections in order to be able to provide strong pinna cues.

Figure 8:
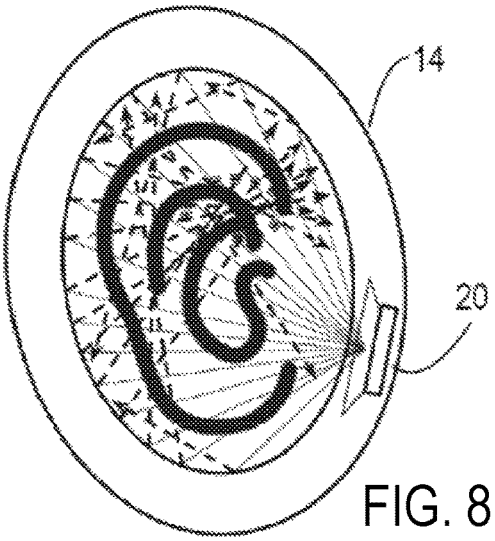
FIG. 8 schematically illustrates a further headphone arrangement.

Both the shape of the ear cups 14, as well as the position of the loudspeakers 20, 22 on the ear cup 14 influences the sound field because, depending on these parameters, more or fewer reflections are generated when a source is used that is directional at least to a certain extent. Depending on the size of the ear cups, the loudspeaker position and the size of the loudspeakers, reflected sounds may primarily intersect in a single focus point or in certain areas within the opposing external boundaries provided by the ear cups. This is exemplarily illustrated in FIG. 8. In FIG. 8, a single loudspeaker 20 is arranged on the frame of the ear cup 14 in front of the pinna (frontal part of the ear cup). Although the loudspeaker 20 emits a main radiation lobe at an angle >0° with respect to the horizontal plane (main direction of sound propagation is directed upwards towards the first axis x), it has been replaced by a point source which radiates sound uniformly in all directions that are not blocked by any boundary surfaces for the following considerations. In the Example of FIG. 8, the ear cup 14 has an oval shape. This, however, is only an example. The reflections depend on the position of the loudspeaker 20 as well as on the angle at which the loudspeaker 20 emits sound with respect to the horizontal plane. Direct sound emitted from the loudspeaker 20 is illustrated with continuous lines in FIG. 8. Reflections are illustrated in dashed lines and a focal point with a high number of intersected reflection paths is marked by a dotted triple line. In the present example this focal point is located just above the concha of a schematically illustrated pinna that has been added for positional reference. Reflections illustrated in FIG. 8, however, are not influenced by the pinna, but merely represent the case in which no pinna is present in the ear cup. When a pinna is present inside the ear cup, reflections will be altered because parts of the ear cup structure are shaded by the pinna and new reflections may arise between parts of the pinna and parts of the ear cup. Generally, everybody possesses an individual pinna shape and, therefore, also the resulting reflections are individual for different users. The pinna shades at least parts of the ear cup 14 that are located behind the pinna. Both the parts of the ear cup 14 that are arranged opposite to the loudspeaker 20 and the pinna reflect sound emanated by the loudspeaker. Due to a plurality of factors, the resulting sound field is not deterministic.

In some embodiments, the present disclosure avoids opposing surfaces that are arranged essentially in parallel to the loudspeaker membranes or that are arranged essentially perpendicular to the direction of sound propagation from the loudspeaker towards the first axis x projected onto the median plane. The at least one loudspeaker 20 may be arranged at an angle >0° to a symmetry axis of the ear cup 14 (e.g., axis B-B' in FIG. 10). For example, if the ear cup 14 has an oval cross section, it has two symmetry axes. The membrane of each loudspeaker 20 may comprise a first side, which faces a cavity inside the frame of the ear cup 14, and a second side, which faces the outside of the frame. The membrane of the loudspeaker may be arranged such that its second side is angled towards the horizontal plane. If the at least one loudspeaker 20 is arranged outside the symmetry axes and, optionally, the second side of the membrane is angled towards the horizontal plane and the first axis x, no direct sound is emanated along the symmetry axes. This reduces reflections from the opposing direction. Depending on the form of the ear cup 14 (an oval form is just one example), the loudspeaker locations may be chosen such that the main focus area of the reflections is located distant to the most sensible regions for pinna resonances, e.g., distant to the concha area.

Figure 9:
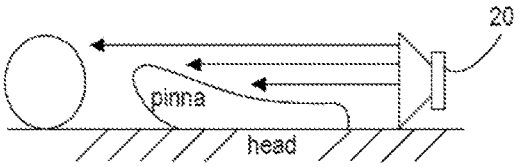
FIG. 9 schematically illustrates a side view of a pinna functioning as a natural barrier for sound waves.

Additionally or alternatively, the rear part of the ear cup 14 may be hidden behind the rear part of the pinna. The rear part of the pinna usually extends further outwards from the head than the frontal part of the pinna. Thereby it provides a natural barrier and the area directly behind the rear part of the pinna is usually shaded from the direct sound coming from the at least one loudspeaker 20, if the at least one loudspeaker 20 is arranged on the frontal half of the ear cup 14. The sound emanated from the loudspeaker 20 may spread away over the pinna, but parts that are arranged in the area directly behind the pinna are shaded and, therefore, not hit by direct sound. Parts that are arranged directly behind the pinna, therefore, do not cause any reflections towards the pinna. This is schematically illustrated in FIG. 9.

Figure 10:
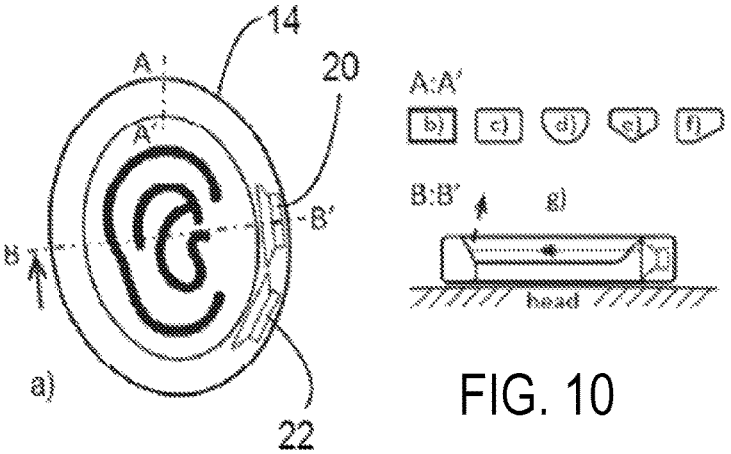
FIG. 10, including FIGS. 10 *a*) to *g*), schematically illustrates a headphone arrangement and different cross sections of an ear cup.

Another possibility for reducing reflections into the region of the pinna or, even more importantly, to the concha, is to direct the reflections away from the pinna or concha. Generally, inner wall sections of the ear cup 14 that potentially face the concha area of the user's ear when the headphone is worn by the user in the usual listening position may be minimized with regard to their surface area in order to minimize reflections towards the concha. This is schematically illustrated in FIG. 10. The material forming the frame of the ear cup 14 may have a suitable cross section that allows directing reflections away from the pinna. Different cross sections along plane A-A' as illustrated in FIG. 10 *a*) are schematically illustrated in FIGS. 10 *b*)-f). A cross section which mainly provides inner wall sections essentially opposing at least one of the loudspeakers that are essentially parallel to the loudspeaker membrane of the example in FIG. 10 or, more general, perpendicular to the median plane (see cross sections b) and c), for example), directs most reflections in the direction of the pinna. An inner wall section in this context is a wall section of the frame that adjoins the open volume within the frame and faces the first axis x. Therefore, the acute angle between inner wall sections and the median plane may be >0° and <90° or, in other words, wall sections parallel to the median plane do not belong to the inner wall sections. Inner wall sections which are close to perpendicular to the median plane (close to 90° such as 90°±5°, for example) are prone to directing reflections towards the pinna. Furthermore, depending on their surface orientation with respect to the pinna or concha, inner wall sections for which the acute angle is <90° with respect to the median plane may still be prone to directing reflections towards the pinna if they are facing the side of the pinna that contains the concha or the concha itself. Inner wall sections for which the acute angle is <90° with respect to the median plane and for which the surface area is facing away from the pinna, are increasingly less likely to cause reflections in the direction of the pinna, the smaller the acute angle is.

A rounded cross section as is illustrated in FIG. 10 *d*), in contrast to FIGS. 10 *b*) and *c*), directs reflections at least partially away from the pinna, as only part of its inner wall sections is at an angle of close to 90° with respect to the median plane. A cross section that includes an essentially plane inner wall that is beveled at an angle <90° with respect to the median plane also directs at least part of the reflections away from the pinna. Examples of such cross sections are schematically illustrated in FIGS. 10 *e*), f) and g). In some examples (not illustrated in FIG. 10), the whole inner wall of the frame facing the open volume may be beveled. However, as sections of the inner wall may be hidden behind the pinna, in some embodiments only an upper or a lower part of the inner wall is beveled. Those parts of the ear cup 14 that are completely hidden behind the pinna may be essentially parallel to the loudspeaker membrane illustrated in FIG. 10 or, more general, perpendicular to the median plane (see, e.g., FIG. 10 *g*)). This also applies for the rounded cross section as illustrated in FIG. 10 *d*). Parts that are hidden behind the pinna may be essentially parallel to the loudspeaker membrane in FIG. 10 and perpendicular to the median plane and only those parts that protrude from behind the pinna may have a rounded or beveled shape. The cross sections illustrated in FIGS. 10 *d*) to *f*), however, are only examples. Any other cross sections of the frame may be implemented that direct reflections away from the pinna or at least away from the concha.

The inner wall of the frame may comprise a plurality of inner wall sections, e.g. a frontal section (arranged in front of the user's ear), a rear section (arranged behind the user's ear), a top section (above the user's ear) and a bottom section (below the user's ear). Any other number and distribution of sections is possible. For example, the sections may be so small that their surface area is approximately flat and, therefore, angled at an angle with respect to the median plane that is equal, with reasonable accuracy (e.g., 1° variation), over the whole section. In one example, only those sections of the inner wall that are arranged essentially opposite to a loudspeaker are beveled at an angle <90°, <75°, or <50° with respect to the median plane. All other sections may be essentially perpendicular (angle of about 90°) to the median plane. It is, however, also possible that more sections are beveled at an angle of <90°, <75°, or <50° with respect to the median plane. This may be beneficial in reducing second order reflections of indirect sound (e.g., first order reflections from other parts of the frame or parts of the pinna) towards the pinna. For example, more than 50%, more than 70% or more than 90% of the inner wall sections may be beveled at an angle of <90°, <75°, or <50° with respect to the median plane and/or face away from the pinna or at least the concha area. The sections may be beveled at an angle >15°, >20°, >30° or >40° and <90°, <80°, <75°, <70° or <60° with respect to the median plane, for example.

Figure 11:
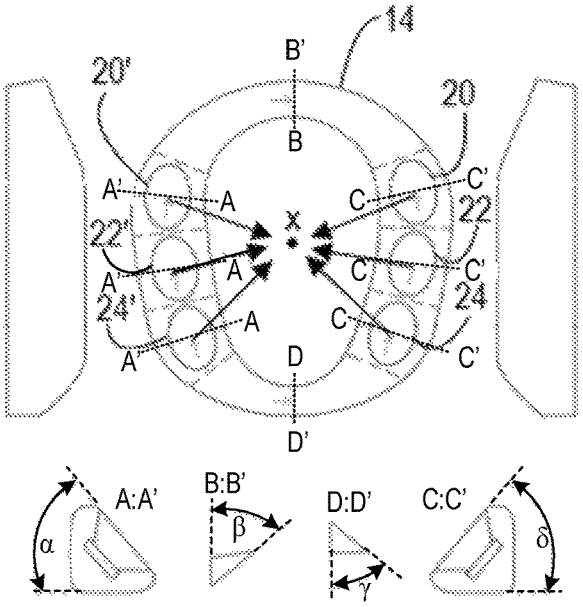
FIG. 11 schematically illustrates a further headphone arrangement.
Figure 12:
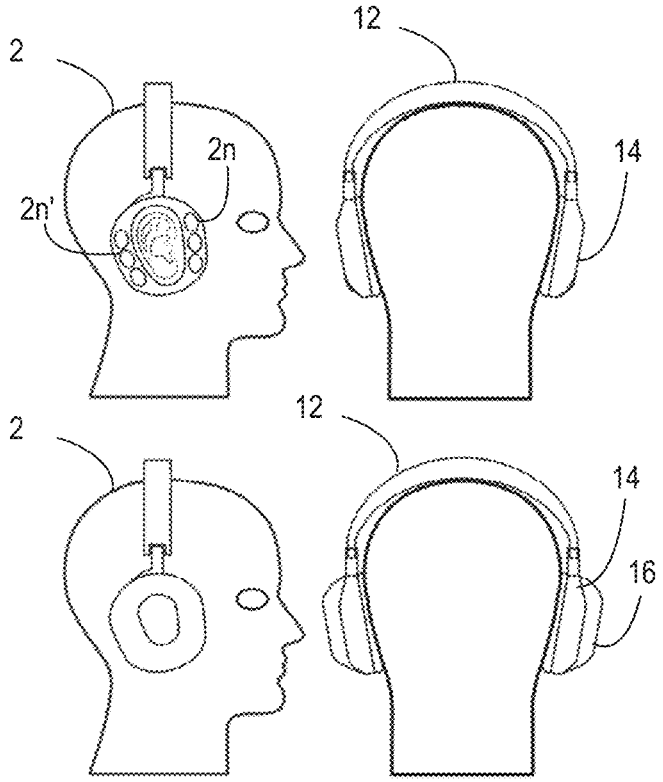
FIG. 12 schematically illustrates the headphone arrangement of FIG. 8 as an open headphone arrangement and a closed headphone arrangement.

A further possibility is to arrange the at least one loudspeaker 20 such that the main sound radiating lobe is directed away from the pinna and/or the median plane, and the user's head and/or the membrane of the loudspeaker, representing a reflective surface, is tilted away from the user's pinna or, in other words, from the median plane. The radiated sound, however, may still be partially directed towards the median plane and thereby the pinna. For example, if the loudspeaker is arranged below the horizontal plane, the main sound radiation lobe may be directed in an upward direction towards the first axis x and the horizontal plane, but away from the median plane, while the radiated sound may partially still be directed towards the pinna and the median plane. This is schematically illustrated in FIG. 11. The loudspeakers 20, 22, 24, 20', 22', 24' may be arranged such that the loudspeaker membrane is arranged at an angle $\alpha$, $\delta$ with respect to the median plane, whereas $0°<\alpha<90°$ and $0°<6<90°$. This, however, is only an example. In another example $15°<\alpha<75°$ and $15°<6<75°$ or, in an even further example $30°<\alpha<60°$ and $30°<6<60°$. If the membrane is arranged at an angle $\alpha$, $\delta$ with respect to the median plane (with $0°<\alpha<90°$ and $0°<6<90°$), the main sound radiation lobe is essentially directed away from the median plane. However, most loudspeakers also radiate sound outside the main radiation lobe. Therefore, the radiated sound may still partially be directed towards the pinna. Only such parts of the sound that are directly radiated or reflected towards the pinna may be heard by the user. Furthermore, the cross sections of the frame at sections B-B' and D-D' may include surfaces that are arranged at an angle $\beta$, $\gamma$ with respect to the median plane, whereas $0°<\beta<90°$ and $0°<\gamma<90°$. The ear cup 14 may have a greater thickness in those parts comprising loudspeakers 2*n*, 2*n*', and may have a reduced thickness in parts that do not comprise loudspeakers, e.g., top and bottom parts of the ear cup 14. The arrangement of FIG. 11 is further illustrated in FIG. 12 as an open headphone arrangement (top) and as a closed headphone arrangement (bottom). In the open headphone arrangement the loudspeakers 2*n* and 2*n*' are visible, whereas in the closed headphone arrangement the loudspeakers 2*n* and 2*n*' are hidden behind the cover 16. Whereas in the arrangement of FIG. 10, for example, the main direction of sound radiation is essentially parallel to the median plane, the main direction of radiation in the arrangement of FIG. 11 is directed away from the median plane. Loudspeakers generally radiate sound essentially uniformly at low frequencies and merely focus sound into a main radiation lobe at high frequencies. This may result in an amplitude response at the pinna, with falling levels towards high frequencies, which may simply be compensated by suitable equalizing filters that boost high frequencies for which loudspeakers usually provide enough headroom in the available sound pressure level. The ear cup arrangement of FIG. 11 reduces reflections directed into the pinna not only of direct sound radiated by one of the loudspeakers (first order reflections), but also of sound reflected by the pinna towards the ear cup arrangement (second order reflections).

An additional or alternative possibility for reducing reflections is the use of sound damping or sound absorbing materials. For example, highly sound absorbing foam materials exist that may be applied to any surface on the ear cup 14, most effectively on any surfaces facing the pinna. For example, sound absorbing materials based on glass mineral wool or cotton may be used. The so-called sound absorption coefficient, which describes the fraction of sound energy absorbed by a material, is known as a performance metric for sound absorbing materials. The sound absorption coefficient generally ranges between 0 (no absorption) and 1 (full absorption), although some measurement methods for determining the sound absorption coefficient may result in values >1. Usually the sound absorption coefficient is frequency-dependent and often tends to increase from low to high frequencies. For the application of sound absorbing materials in the proposed headphone arrangements, the sound absorption coefficient may be greater than 0.5 for frequencies between 2 kHz and 15 kHz or greater than 0.3 for frequencies between 4 kHz and 10 kHz. However, it should be noted that the absorption coefficient generally depends on the thickness of the sound absorbing material, the incident and reflection angles as well as the measurement method that is used to determine the absorption coefficient. For some materials the maximum sound absorption is reached at an intermediate frequency, while sound absorption decreases for lower and higher frequencies. Therefore, the sound absorption may vary over the surface of the headphone arrangement that is covered with sound absorbing material as well as with the frequency content of the sound.

Figure 13:
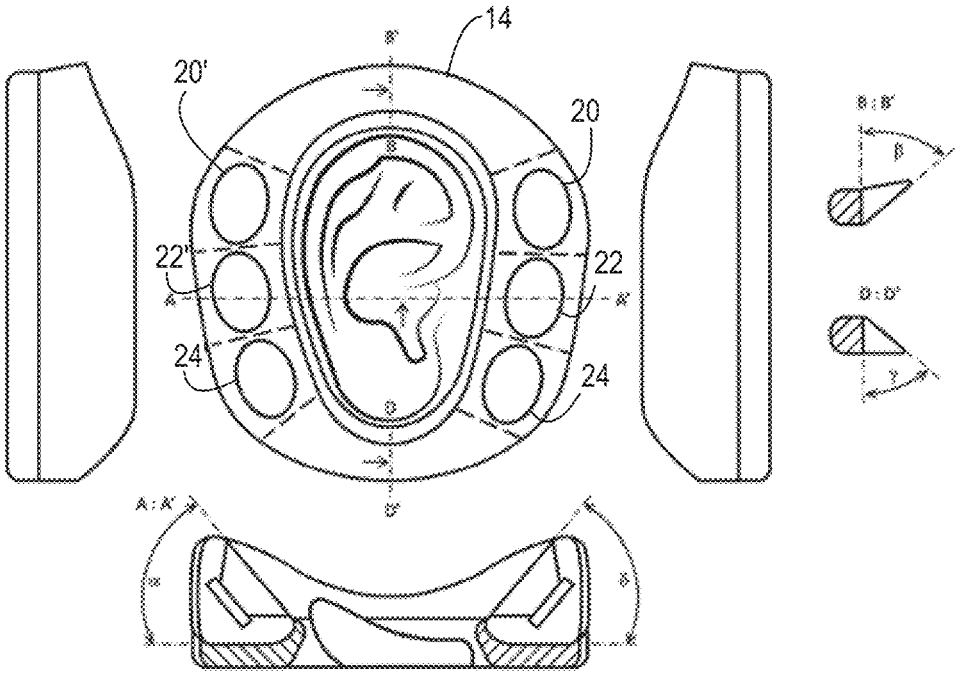
FIG. 13 schematically illustrates a headphone arrangement including sections covered with sound absorbing material.

The use of sound absorbing materials may be combined with any of the above mentioned options for reducing reflections. Referring to FIG. 13, a headphone arrangement is illustrated that comprises loudspeakers 20, 20', 22, 22', 24, 24' whose main direction of sound propagation is directed away from the pinna, as has been described with respect to FIG. 11. In this example, additionally most of the inner wall sections are tilted away from the pinna. The headphone arrangement of FIG. 13 further comprises sound absorbing material (marked as hatched area in FIG. 13). An ear cup 14 may comprise external surfaces or surface sections that are oriented essentially away from the pinna (the vertical of such external surface sections does not point towards the pinna when the headphone is worn by the user in a usual listening position). Other surfaces or surface sections may be oriented essentially towards the pinna, with the vertical pointing towards the pinna. At least some parts of those surfaces or surface sections that are oriented essentially towards the pinna may comprise a sound absorbing material. For example, more than 30%, more than 50% or more than 80% of the surface sections oriented towards the pinna may be covered with sound absorbing material. Surfaces or surface sections that are oriented essentially away from the pinna generally direct any reflections of sound mainly away from the pinna, therefore, such surfaces or surface sections might not necessarily comprise sound absorbing material. Surfaces or surface sections that are oriented essentially towards the pinna, however, generally direct the main part of the reflections towards the pinna. Therefore, sound absorbing material on such surfaces or surface sections may reduce the reflections that are directed towards the pinna. This is schematically illustrated in FIG. 13. Furthermore, it might not be necessary that all surfaces or surface sections that are oriented essentially towards the pinna comprise damping material. While surfaces or surface sections that are arranged opposite to a loudspeaker may comprise a sound absorbing material to reduce reflections, the use of sound absorbing materials may be optional for other surfaces or surface sections that are not arranged opposite to a loudspeaker, because such surfaces or surface sections might receive less direct sound and, therefore, cause fewer reflections. Surfaces or surface sections that are not opposite a loudspeaker may nevertheless be covered by sound absorbing material to reduce second order reflections into the pinna or concha area.

Figure 14:
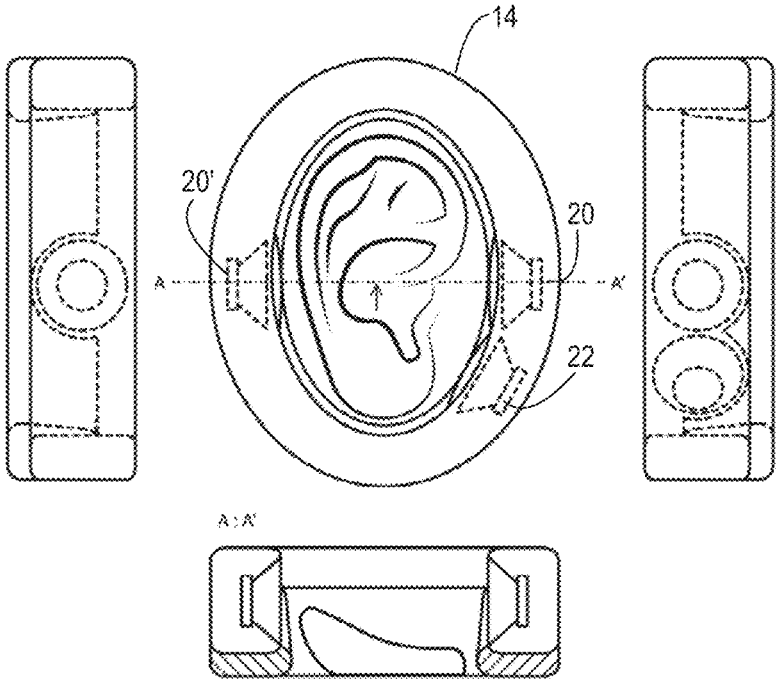
FIG. 14 schematically illustrates a further headphone arrangement including sections covered with sound absorbing material.

However, it is also possible to use sound absorbing materials instead of applying any of the above mentioned solutions. This is schematically illustrated in FIG. 14. In FIG. 14, the hatched area in the cross-section along plane A:A' may comprise a sound absorbing foam, for example, which reduces reflections into the pinna and further functions as a cushion towards the user's head. In the example of FIG. 14, the main direction of sound propagation of the loudspeaker is almost parallel to the median plane and is not directed away from the pinna. Large parts of the inner wall of the ear cup frame face the pinna. Sound absorbing material may, for example, be applied to surfaces or surface sections that surround the loudspeakers 20, 20', 22, 22', 24, 24'. As has been described with respect to FIG. 13, at least parts of the surfaces or surface sections that are oriented essentially towards the pinna may comprise sound absorbing material, while the use of sound absorbing materials is optional for such surfaces or surface sections that are oriented essentially away from the pinna. The sound absorbing material may be configured to reduce the intensity of sound that is reflected by any surface or surface section of the ear cup 14 towards the pinna of the user. Such reflected sound may initially have been emitted by the at least one loudspeaker 20, 20', 22, 22', 24, 24'.

Figure 22:
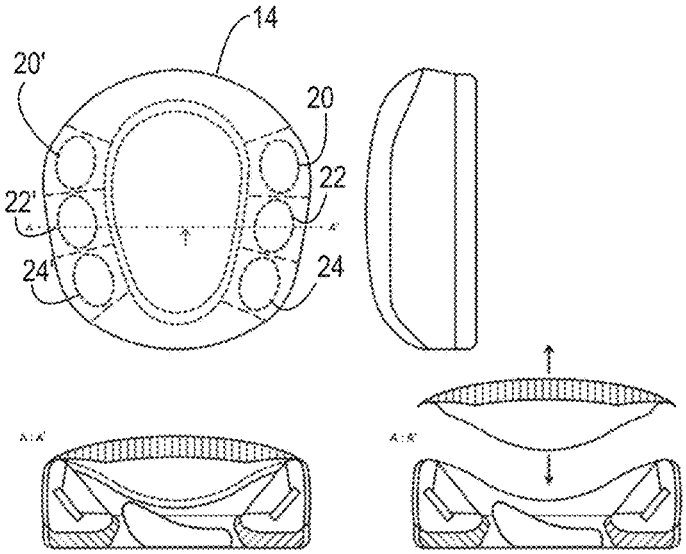
FIG. 22 schematically illustrates a headphone arrangement with a detachable cover including sections with sound absorbing material.

Referring to FIG. 22, sound absorbing material may further be arranged on the internal side of a cover for the ear cup 14 which provides a closed headphone arrangement. In FIG. 22, sound absorbing material on the frame and the cover is marked as hatched areas. A closed volume around the ear may provide the advantage of improved sensitivity and a maximum sound pressure level of the loudspeakers due to the pressure chamber effect. However, even if a closed headphone arrangement using sound absorbing material for the rear cover may not provide the same performance as an open headphone arrangement in view of directional pinna cues, it may come quite close when high performance sound absorbing material is used. The advantages that were already described above may outweigh the potential drawbacks. This, however, highly depends on several factors including the form of the ear cup, the loudspeaker positions and the orientation of the loudspeakers, the number and size of the loudspeakers, and many more. As long as the reflections into the pinna are low compared to the direct signal from the desired direction, adequate natural directional cues can be induced.

Figure 15A:
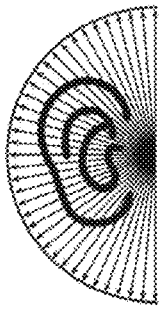
FIGS. 15A and 15B schematically illustrate sound emitted by a point source and by an extended sound source.
Figure 15B:
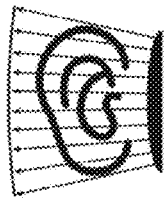

A loudspeaker generally resembles a point source, especially within a distance that is large as compared to the size of its membrane, as is schematically illustrated in FIG. 15A. A point source generally generates a spherical sound wave which may be bounded by the surrounding elements of the ear cup frame. In the example illustrated in FIG. 15A, the point source radiates a hemisphere within the dimensions of the pinna as sound radiation is bounded by an infinite baffle. A larger (extended) sound source on the other hand, as is schematically illustrated in FIG. 15B, may radiate an approximately plane sound wave within the dimensions of the pinna, or at least within the dimensions of the concha. In one embodiment, the loudspeaker arrangement comprises an extended sound source. The extended sound source provides large radiating membrane dimensions compared to the size of the pinna, which increases the directivity of the loudspeaker and generates an approximately plane sound wave. Loudspeaker directivity may be controlled by adapting the loudspeaker membrane dimensions. The larger the size of the loudspeaker membrane, or more specifically the sound emitting part of the membrane in a certain dimension, the more focused the sound beam emitted by the loudspeaker in the corresponding direction. Focused sound sources usually cause fewer reflections than omni-directional sound sources. As the directivity of loudspeakers depends on the size of the sound radiating surface (membrane) relative to the wavelength of the emitted signal, especially higher frequencies (e.g., above 4 kHz) benefit from increased directionality of the loudspeaker. Loudspeakers that are large as compared to the size of the pinna (or concha) generally better resemble the situation in the far field of a source. In such situations the sound wave within the dimensions of the pinna predominantly travels in one direction instead of expanding in all directions. FIGS. 15A and 15B demonstrate the differences between small loudspeakers (approximated by a point source in FIG. 15A) and an extended sound source which has equal vertical dimensions as the pinna (see FIG. 15B). As the curvature of the sound field arriving at the ear is an indicator of the distance between the source and the ear and changes drastically in the near field of the source, a sound field with an approximately flat wave front may be used to support the generation of distant sources. A large vertical radiation area may be obtained by a single loudspeaker which is sized accordingly or by arranging two or more loudspeakers in proximity to each other and performing parallel playback on these two or more loudspeakers. Such an arrangement can be seen, for example, in the headphone arrangements of FIGS. 10 and 11. At least two loudspeakers may be arranged adjacent to each other to form an extended sound source that matches the dimension of the pinna or concha parallel to the median plane. An extended sound source could also comprise a single loudspeaker that matches a dimension of the pinna or concha parallel to the median plane. In both cases, the extended sound source may have an extension of at least 25 mm in a dimension parallel to the median plane.

Remaining reflections may still adversely bias the perceived source localization, especially the elevation angle of the sound image. An additional or alternative possibility is to shift the loudspeaker position along the opposing boundaries of the ear cup to compensate for the elevation bias. Users generally tend to locate frontal sound sources above the head or in front of the forehead when headphone playback with HRTF-based filtering is implemented. A comparable effect can be observed with normal stereo loudspeaker playback where the phantom image between the loudspeakers is often perceived above the physical loudspeaker position. One possibility for compensating for such phantom image or virtual source elevation effects for playback over the proposed headphone arrangements is to position the loudspeakers that are intended for generating frontal directional pinna cues associated with an elevation angle of 0° below a horizontal plane through the ear canal or, in particular, through the first axis x to compensate for the tendency of increased elevation angle perception.

For example, one or more loudspeakers may be arranged below the horizontal plane through the first axis x on a frontal part of the frame such that they provide sound to the ear of the user from a lower frontal direction. In particular, at least one of the acoustic center of at least one loudspeaker, the geometric center of at least one loudspeaker, and the geometric center of at least one loudspeaker membrane may be arranged below the horizontal plane on a frontal part of the frame such that it provides sound to the ear of the user 2 from a lower frontal direction when the at least one ear cup is arranged around the ear of the user (user wears the ear cup and the ear cup encircles the ear of the user). If only one loudspeaker is arranged below the horizontal plane on a frontal part of the frame, its perceptional relevant direction of sound propagation (from the loudspeaker to the concha) may be angled at an angle σ with respect to the horizontal plane (indicated with arrows in FIG. 16A). In one example, its perceptional relevant direction of sound propagation may be angled at an angle σ of about 10° to about 40° with respect to the horizontal plane. The perceptional relevant direction of sound propagation in this context is the perpendicular projection onto the median plane of the direction of sound propagation from the acoustic center of the loudspeaker or the geometric center of the loudspeaker membrane towards a point on the first axis x. If two or more loudspeakers are arranged on the frontal part of the frame below the horizontal plane, the perceptional relevant direction of sound propagation of each individual loudspeaker may be angled with respect to the horizontal plane, and an average angle of the respective perceptional relevant directions of sound propagation may be between about 10° and about 40°.

Figures 16A, 16B, 16C, 16D:
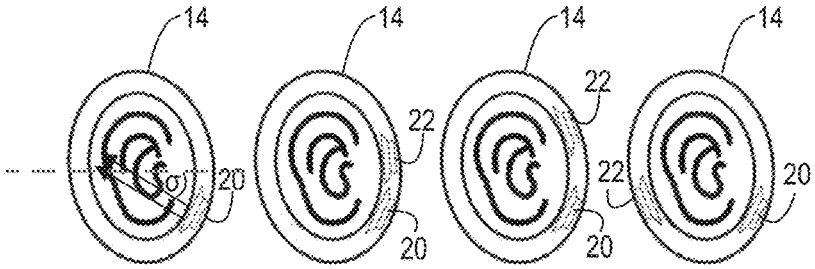
FIGS. 16A to 16D schematically illustrate different loudspeaker positions for generating directional pinna cues for the frontal hemisphere.

FIGS. 16A to 16D schematically illustrate a headphone arrangement. In FIG. 16A, the headphone arrangement comprises one loudspeaker 20 that is arranged on the frontal part of the ear cup 14. The loudspeaker 20 emits sound towards the area of the concha from below the horizontal plane (perceptional relevant direction of sound radiation) with an angle greater than 0° and less than 90° between the perceptional relevant direction and the horizontal plane. The loudspeaker 20 is arranged below the horizontal plane and emits the highest sound energy upwards in a direction towards the first axis x (main direction of sound radiation defined by the highest level of radiated sound averaged over the complete radiation frequency range). The perceptional relevant direction of sound radiation from the loudspeaker towards the concha region and the main direction of sound propagation may match in some cases, but generally are independent from each other. As has already been described before, an adaption of the elevation angle of the loudspeaker 20 with respect to the horizontal plane (and thereby the perceptional relevant direction of sound radiation) may lead to an improved directional bias in the presence of unavoidable reflections and/or a general tendency of users to perceive a more elevated frontal image than provided by the loudspeaker location (loudspeaker elevation angle and perceptional relevant direction of sound radiation differ from the perceived elevation angle of the sound). A second loudspeaker 22 may be arranged on the frontal part of the ear cup 14, as is illustrated in FIG. 16B. The second loudspeaker 22 may emit sound at an angle of approximately 0° to the horizontal plane (perceptional relevant direction of sound radiation approximately parallel to the horizontal plane). Together the first and second loudspeaker 20, 22 may form an extended sound source which provides further advantages, as has been described before. For example, a plane wave sound field may be approximated and reflections may be reduced through increased directivity. An increased membrane area may also lead to an increase of the maximum possible sound pressure level and to reduced distortion. However, the second loudspeaker 22 in another embodiment, as illustrated in FIG. 16C, may emit sound towards a perceptional relevant direction with an angle greater than 0° and less than 90° with respect to the horizontal plane from above. The loudspeaker 22 is arranged above the horizontal plane and emits the highest sound energy downwards in a direction towards the first axis x (main direction of sound radiation). Such an arrangement, as well as an arrangement according to FIG. 16B, allow to control the perceived elevation angle of virtual sound sources by controlling the signal distribution between the two loudspeakers 20, 22. In another embodiment, as is illustrated in FIG. 16D, the second loudspeaker 22 is arranged on the rear part of the ear cup and is configured to supplement the first loudspeaker 20 at low frequencies, e.g., below 100 Hz-200 Hz or below 4 kHz.

In embodiments that comprise multiple loudspeakers 20, 22, it is generally possible to split the audio frequency range between loudspeakers in order to form multi-way loudspeakers. The frequency range above about 100 Hz-200 Hz may increasingly affect the directional cues for human voices and includes the fundamental tones of many instruments, although a lower crossover frequency is usually desirable for a better localization of instruments in the presence of loudspeaker noise and distortion. Speakers playing at frequencies below about 100 Hz-200 Hz generally have a decreasing influence on directional cues with decreasing frequency. Therefore, multiple speakers may be combined with each other for the low frequency end of the headphone arrangement's frequency range to achieve a better bass performance. If the loudspeaker arrangement comprises multiple loudspeakers (more than one loudspeaker), the rear volumes of the individual loudspeakers may be separated in order to avoid crosstalk and other detrimental interactions between the different loudspeakers. In such a case the volume inside the hollow frame may be divided into multiple separate cavities, each cavity forming a separate enclosure for a single or for multiple loudspeakers.

Figure 17A:
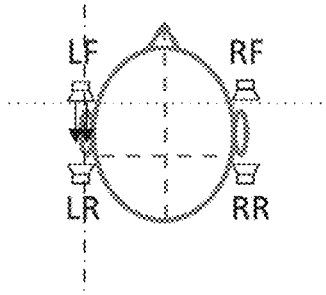
FIGS. 17A to 17D schematically illustrate loudspeakers positioned relative to a plane through the ear canal entry which is parallel to the median plane, loudspeakers that are positioned at different distances from the plane and loudspeakers rotated inwards and loudspeakers that are rotated outwards.

It is noted that especially azimuth, but also elevation angles of the loudspeakers or, more specifically, the angles between the sound radiation direction from the loudspeaker to the entry of the ear canal and the median and horizontal planes, respectively, do not need to exactly match the azimuth and elevation angles of the desired virtual sound source position. Individual frontal pinna cues facilitate image generation in the frontal hemisphere by additional suitable signal processing, even if these angles do not match. In some embodiments the loudspeakers 20, 22 are placed directly in front of the pinna in order to generate pinna cues resembling the pinna cues caused by a center speaker of a surround sound setup, instead of, for example, placing the loudspeakers 20, 22 on the frontal side of the ear cup 14 to emulate the pinna resonances induced by typical stereo loudspeaker positions. This is exemplarily illustrated in FIGS. 17A to 17D. FIG. 17A schematically illustrates a loudspeaker arrangement where the frontal loudspeakers LF, RF are arranged directly in front and the rear loudspeakers LR, RR are arranged directly behind the pinna, approximately in a plane that is arranged parallel to the median plane that intersects the entry of the ear canal. Such an arrangement of the frontal loudspeakers resembles the direction of incoming sound from a center speaker.

Figure 17B:
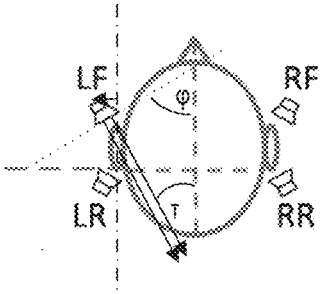
Figure 17C:
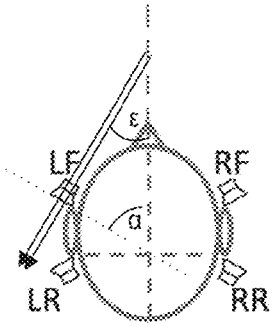
Figure 17D:
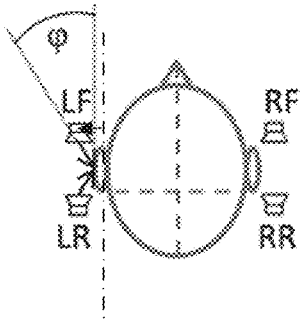

FIGS. 17B and 17D, on the other hand, schematically illustrate front speakers LF, RF that are shifted away from the user's head and thereby away from a plane parallel to the median plane that intersects the entry of the ear canal. In the example of FIG. 17B, the front speakers LF, RF are rotated with respect to the median plane. In the example of FIG. 17D, the front speakers LF, RF are not rotated towards the user's ear. However, part of the sound in the example of FIG. 17D still reaches the ear canal of the user. In other words, in both examples a perceptional relevant direction of sound propagation is angled at an angle $\tau$ with respect to the median plane and directed towards the median plane (indicated with arrows in FIG. 17B). The second arrangement (FIGS. 17B, 17D) generally better resemble the direction of sound that is received from loudspeakers positioned in a stereo triangle. However, this is only true for the loudspeaker of a stereo setup that is arranged on the same side of the user as the respective ear. The sound from the loudspeaker on the opposite side bends around the head and reaches the pinna from a frontal direction, as is the case for the frontal loudspeakers in FIG. 17A. As the loudspeaker arrangement of FIG. 17B essentially increases the amount of reflections from the area of the loudspeaker membrane towards the pinna, the arrangement of the loudspeakers as illustrated in FIG. 17A is generally better suited for the introduction of pinna resonances associated with frontal source directions.

FIG. 17C illustrates a loudspeaker arrangement in which the loudspeakers are rotated away from the median plane but are still arranged close to (or are intersected by) a plane parallel to the median plane that intersects the entry of the ear canal. In other words, the main direction of sound propagation is essentially angled at an angle c with respect to the median plane and directed away from the median plane (indicated with arrows in FIG. 17C) and/or the loudspeaker membranes are essentially angled at an angle $\alpha$ with respect to the median plane and directed away from the median plane (indicated in dotted lines in FIG. 17C). The angle $\sigma$ in FIG. 17C corresponds to the angles $\alpha$ and $\delta$ in FIG. 11. As has already been explained with respect to FIG. 11, $\alpha$ may be between 0° and 90°, between 15° and 75° or between 30° and 60°, for example. The arrangement of FIG. 17C may achieve even better results with regards to the reduction of reflections towards the pinna region than the arrangement illustrated in FIG. 17A, while inducing equal directional pinna cues due to the largely identical perceptional relevant direction of sound propagation from the loudspeaker towards the entry of the ear canal or the area of the concha.

As already described before, effective individual directional pinna cues may be more easily induced for the rear hemisphere than for the front hemisphere. However, if it is desired to provide virtual sound sources behind the user (rear hemisphere), the loudspeaker arrangement requires loudspeakers that are arranged on the rear part of the ear cup behind the pinna. Binaural synthesis by means of generalized HRTF filtering usually cannot outweigh the frontal pinna cues that are generated by the headphone arrangements with frontal loudspeakers as described above. However, a partial shading by the pinna and induced reflections from frontal surfaces of the ear cup are generally less critical for rear loudspeakers than for frontal loudspeakers. Generally, rear loudspeakers may be arranged in the same way as frontal loudspeakers.

Figures 18A, 18B, 18C, 18D:
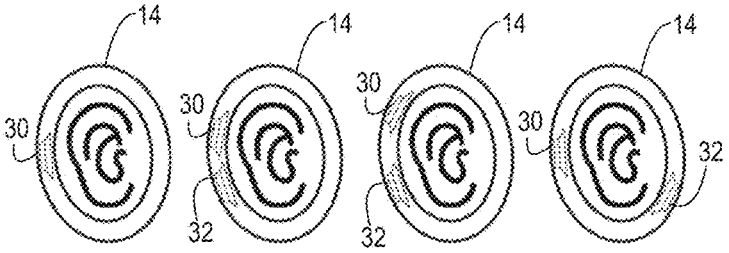
FIGS. 18A to 18D schematically illustrate different loudspeaker positions for generating directional pinna cues for the rear hemisphere.

FIGS. 18A to 18D schematically illustrates several possible loudspeaker arrangements. In the embodiment of FIG. 18A, the loudspeaker arrangement comprises a first rear loudspeaker 30 that is arranged on the rear part of the ear cup 14. The first rear loudspeaker 30 is arranged such that it emits sound from behind the pinna in a direction essentially parallel to the horizontal plane. The embodiment in FIG. 18B further comprises a second rear loudspeaker 32. While the first rear loudspeaker is arranged slightly above the horizontal plane and emits sound at an angle >0° with respect to the horizontal plane from above, the second rear loudspeaker 32 is arranged slightly below the horizontal plane and emits sound at an angle >0° with respect to the horizontal plane from below. Two loudspeakers 30, 32 that are arranged within relative close proximity to each other may resemble an extended sound source that generates an approximately plane sound wave and improves maximum sound pressure levels. The angle at which the loudspeakers 30, 32 emit sound with respect to the horizontal plane may be varied, as can be seen in FIG. 18C. If the loudspeakers 30, 32 are spaced farther apart from each other, the elevation angle of the virtual sound source may be controlled by controlling the signal distribution between the loudspeakers 30, 32. By arranging one of the loudspeakers 32 on the frontal part of the ear cup 14, the frontal loudspeaker 32 may supplement the rear loudspeaker 30 at low frequencies to improve the bass performance.

Individual pinna cues from the rear facilitate image generation in the rear hemisphere by suitable signal processing methods even if the azimuth and elevation angles of the rear loudspeakers do not match the azimuth and elevation angles of the desired virtual sound sources. Therefore, rear loudspeakers 30, 32 may be arranged directly behind the pinna. A loudspeaker position directly behind the pinna is generally least disruptive for the frontal loudspeakers 20, 22. The frontal loudspeakers 20, 22 are usually more important than the rear loudspeakers 30, 32, due to the challenges for central front image generation, as has been described above.

FIGS. 19A to 19D schematically illustrate possible loudspeaker arrangements that may be used if it is desired to provide virtual sources all around the user. In the embodiment illustrated in FIG. 19A, the loudspeaker arrangement comprises a first frontal loudspeaker 20 and a first rear loudspeaker 30. The first frontal loudspeaker 20 is arranged on the frontal part of the ear cup 14. The perceptional relevant direction of sound propagation of the first frontal loudspeaker 20 may be angled at an angle $\sigma$ with respect to the horizontal plane (indicated with arrows in FIG. 19A). In one example, its perceptional relevant direction of sound propagation may be angled at an angle $\sigma$ of about 0° to about 90°, about 10° to about 90°, or about 20° to about 90° with respect to the horizontal plane, wherein the first frontal loudspeaker is arranged below the horizontal plane. The first rear loudspeaker 30 is arranged on the rear part of the ear cup 14. The perceptional relevant direction of sound propagation of the first rear loudspeaker 30 essentially parallel to the horizontal plane (indicated with arrows in FIG. 19A). However, in other examples, its perceptional relevant direction of sound propagation may be angled at an angle $\omega$ of about 0° to about 90°, about 10° to about 90°, or about 20° to about 90° with respect to the horizontal plane (indicated with dotted lines in FIG. 19A). In one example, $\sigma \neq \omega$. The angle between the main direction of sound propagation of the lowest frontal loudspeaker and the main direction of sound propagation of the lowest rear loudspeaker may be >90°. With this arrangement natural pinna cues may be provided by the individual loudspeakers that are associated with frontal or rear source directions, while bass may be provided by one or both speakers.

Figures 19A, 19B, 19C, 19D:
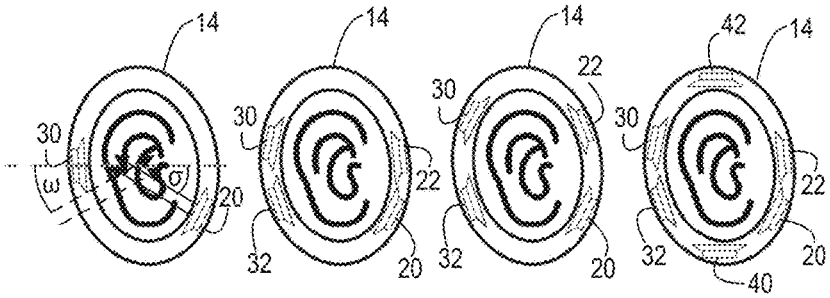
FIGS. 19A to 19D schematically illustrate different loudspeaker positions for generating directional pinna cues for the frontal and the rear hemisphere.

An approximately plane sound wave may be generated from the front and the back by arranging a second frontal loudspeaker 22 adjacent to the first frontal loudspeaker 20 and a second rear loudspeaker 32 adjacent to the first rear loudspeaker 30. The frontal loudspeakers 20, 22 and the rear loudspeakers 30, 32, respectively, may form a frontal loudspeaker group and a rear loudspeaker group and loudspeakers in one loudspeaker group may play in parallel for an improved listening experience. This is illustrated in FIG. 19B. In another example, more than two loudspeakers may be arranged adjacent to each other to form a frontal loudspeaker group and/or a rear loudspeaker group. One (or more) frontal loudspeakers 20, 22 in the frontal loudspeaker group may be arranged below the horizontal plane as has been described with respect to FIG. 19A and one frontal loudspeaker may be arranged such that its main direction of sound propagation is essentially parallel to the horizontal plane. One or more frontal loudspeakers, however, may additionally or alternatively be arranged above the horizontal plane with their main direction of sound propagation directed towards the horizontal plane. The same applies to the rear loudspeakers 30, 32. An average perceptual relevant direction of sound propagation for at least a first loudspeaker group may be angled at an angle with respect to the horizontal plane, and the average perceptual relevant direction of sound propagation of at least the first loudspeaker group may be essentially opposing (>90° difference) the average perceptual relevant direction of sound propagation of at least a second loudspeaker group or the perceptual relevant direction of sound propagation of at least one additional loudspeaker Alternatively, precise elevation angle control may be achieved by controlling the signal distribution between the upper loudspeaker and the lower loudspeaker on the frontal or the rear part of the ear cup. If the first frontal loudspeaker 20 and the second frontal loudspeaker 22 are arranged such that the angle between their perceptional relevant directions of sound propagation increases (e.g., >20°, >30°, or >40°), the range over which the elevation angle can be controlled increases. The same applies to the angle between the perceptional relevant direction of sound propagation for the first and second rear loudspeakers 30, 32. Such an arrangement is schematically illustrated in FIG. 19C. A lower loudspeaker 40 may further be arranged on a bottom part of the ear cup 14 to emit sound in an upward direction that is essentially perpendicular to the horizontal plane. An upper loudspeaker 42 may be arranged on an upper part of the ear cup 14 to provide sound in a downward direction that is essentially perpendicular to the horizontal plane (see FIG. 19D). In this way virtual source directions above and below the users ear may be supported. Loudspeakers above and below the pinna may also be used exclusively for low frequency playback in order to improve the bass performance. The type of loudspeakers may be chosen individually for the best performance in the intended frequency range. The loudspeaker arrangements illustrated above, however, are only examples. Any number of loudspeakers may be placed around the pinna in order to achieve the desired source directions on the median plane as well as the desired low frequency extension. The loudspeakers in one arrangement may be of the same kind and size or of different kinds or sizes.

The externalization of the perceived sound image may be further improved by additional signal processing in combination with the loudspeaker arrangements disclosed herein. Furthermore, signal processing may be applied to control the azimuth and elevation angles of virtual sources, as well as the distance of the virtual sources from the user. However, even without additional signal processing, partial externalization of the sound image may be achieved with the loudspeaker arrangements as disclosed herein and, even more importantly, when using the loudspeaker arrangement according to the present disclosure, a user may distinguish the different directions of sound sources in the front, the back, above or below that are associated with the different loudspeakers.

It should be noted that the proposed headphone arrangements may include multiple loudspeakers that may be individually controlled by individual electrical sound signals. Furthermore, the voice coil impedance and/or efficiency of the loudspeakers may not be compatible with standard headphone amplifiers, as, for example, headphone amplifiers as provided in many smart phones today. Therefore, the headphone arrangement may include at least one electronic driving unit that is configured to receive an input signal and to apply the conditioned input signal as a driving signal to a single or multiple loudspeakers. Furthermore, processing of the electrical sound signals may be required in some applications in order to achieve certain sound quality or spatial sound characteristics. Therefore, the headphone arrangement may include at least one signal processing unit that is configured to receive at least one input signal, to process the at least one input signal and to emit at least one processed input signal to at least one electronic driving unit.

Figure 20:
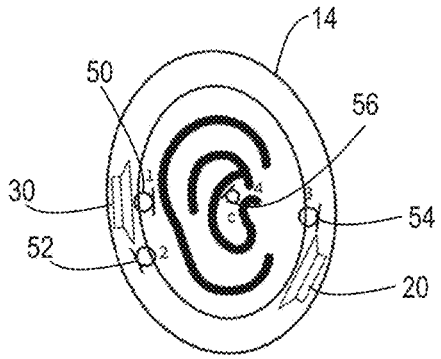
FIG. 20 schematically illustrates a loudspeaker arrangement including feedback microphones.

As is illustrated in FIG. 20, the loudspeaker arrangement may further comprise at least one first feedback microphone 50, 52, 54 and/or a second feedback microphone 56. The at least one first feedback microphone 50, 52, 54 may be arranged in close proximity to at least one of the loudspeakers 20, 30. In FIG. 20 two loudspeakers 20, 30 are illustrated. This, however, is only an example. The loudspeaker arrangement may include any other number and position of loudspeakers 20, 30. By arranging at least one first feedback microphone 50, 52, 54 in close proximity to at least one of the loudspeakers 20, 30, distortion compensation of the respective loudspeakers 20, 30 may be provided by providing at least one feedback loop including, among additional signal conditioning and processing units, the at least one first microphone 50, 52, 54 and the respective loudspeaker 20, 30. The loudspeakers 20, 30 may be pushed towards their physical limitations, particularly for low frequency playback. Therefore, distortion compensation may be essential in the context of the proposed loudspeaker arrangements in order to improve sound quality to an acceptable or a desired level. For active noise cancellation (ANC) one or more second feedback microphones 56 may be arranged in close proximity to the ANC target position, e.g., the entry of the ear canal which is the position for which noise generally should be suppressed. The positions of the first and second feedback microphones 50, 52, 54, 56 illustrated in FIG. 20 are only examples. One or more first feedback microphones 50, 52 may be positioned in close proximity of a rear loudspeaker 30 and may be included, among additional conditioning and processing units, in a feedback loop with the rear loudspeaker for distortion compensation. At least one further first feedback microphone 54 may be arranged in close proximity to a frontal loudspeaker 20 and may be included in a feedback loop with the frontal loudspeaker and other additional signal conditioning and processing unit for distortion compensation. A second feedback microphone 56 may be arranged close to the entry of the ear canal to provide a feedback signal for a feedback loop for ANC, wherein the feedback signal may be conditioned and processed by additional electrical units to provide ANC functionality. The feedback loop for ANC may also include at least one of the loudspeakers 20, 30. A second feedback microphone 56 may be held in position close to the ear canal using a bar that is coupled to the ear cup 14 (not illustrated in FIG. 20). Other mounting systems may include any kind of cords that are coupled to the ear cup to hold the second feedback microphone 56 in place. If a rear cover is mounted/attached to the ear cup 14 as has been described above, a second feedback microphone 56 may be coupled to the cover at a position that is arranged close to the ear canal when the cover is mounted/attached to the ear cup 14. Any kind of bar may be attached to the cover which may hold a microphone in place when the cover is mounted/attached to the ear cup 14.

If a cover 16 is provided to be attached to the ear cup 14, as has been described with respect to FIGS. 21A and 21B before, external microphones may be arranged on the outside of the headphone arrangement (outside the volume enclosing the ear of the user) either on the cover or the frame of the ear cup to provide active noise cancellation based on feed forward techniques and for support of awareness modes for acoustical events in the environment. The headphone arrangement may comprise a first feed forward path that is configured to provide active noise cancellation and to support awareness modes for acoustical events in the environment of the user. The first feed forward path may comprise at least one microphone that is arranged outside the closed volume, e.g., on the cover or the frame of the ear cup 14. Active noise cancellation techniques as well as awareness modes are known in the art and, therefore, are not described in further detail. The placement of microphones outside the ear cups 14 allows for an improved noise cancellation performance, especially for frequency ranges that may not be included into feedback loops due to stability issues. On the other hand, the same microphones may be used to playback external sound inside the headphones for awareness of acoustical events in the user's environment. This may be useful, for example, if the user walks through environments such as city traffic, for example, and needs to be aware of the environmental noise, e.g., traffic noise, due to safety reasons or if the user intends to talk to other people. In order to achieve feed forward noise cancellation or ambience awareness modes, signal conditioning and processing units may be required between the external microphones and at least one of the loudspeakers of the headphone arrangement. As the detailed feed forward chain is not subject to the present disclosure and multiple examples of such signal chains are commonly known, no further details are given in this regard.

Although a closed box design, where the rear part of the loudspeaker is enclosed inside the internal volume of the hollow frame, is generally suitable for the proposed loudspeaker arrangement, it is further possible to add passive radiators or bass reflex tubes, as known in the art, to the loudspeaker arrangement to induce one or more resonant circuits to improve low frequency output.

Because directional pinna cues manifest themselves as peaks and dips in the amplitude response that can be measured at the blocked ear canal, the loudspeakers may be free of comparable peaks and dips as may, for example, be caused by membrane resonances above the so-called breakup frequency of the membrane. Relatively small and stiff membranes as well as damped membranes may be used to shift the membrane resonances out of critical frequency ranges, e.g., to above 15 kHz, or to reduce membrane resonances which could otherwise erroneously induce false pinna cues.

Figure 23:
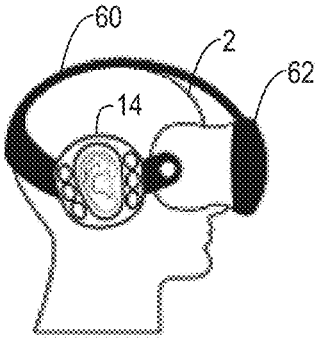
FIG. 23 schematically illustrates a virtual reality headset combined with a headphone arrangement according to the present disclosure.

Referring to FIG. 23, the headphone arrangement disclosed herein may be combined with a virtual reality (VR) headset. The headset may comprise a support unit 60 that is configured to be arranged on the user's head. The support unit may include a headband or any kind of straps that are suitable to hold the headset in place on the user's head. A VR display 62 may be permanently integrated in the headset. It is, however, also possible that the headset comprises a mounting/attaching fixture. The VR display, e.g., a cell phone or anything similar, may be detachably mounted/attached on the mounting/attaching fixture if the user wants to use the VR headset. If not needed, the display 62 may be removed from the mounting/attaching fixture. The ear cup 14 of the headphone arrangement may be fixed to the headset in any suitable way. The ear cup 14 may be permanently or detachably fixed to the headset. The headset with the headphone arrangement of the present disclosure may provide sound with controlled induction of natural directional pinna cues for any VR applications.

According to one example, a headphone arrangement is configured to generate natural directional pinna cues. The arrangement may comprise at least one ear cup comprising a frame that is configured to be arranged to encircle the ear of a user, thereby defining an open volume around the ear of the user, wherein the frame is at least partially hollow, thereby providing at least one cavity on its inside that is separated from the outside by at least one wall of the frame. The exemplary arrangement further comprises at least one loudspeaker arranged in a wall of the frame of the ear cup, wherein a first side of the at least one loudspeaker faces a cavity inside the frame and a second side of the at least one loudspeaker faces the outside, and wherein at least one of each of the at least one loudspeaker is arranged such that its main direction of sound propagation is essentially parallel to or is directed away from a median plane. The membrane of the at least one loudspeaker is arranged essentially parallel to a frontal plane or is arranged essentially at a first angle with respect to the frontal plane, facing away from the median plane. The median plane crosses the user's head midway between the user's ears, thereby dividing the head exactly in a left side and a right side and the frontal plane crosses through the ears of the user perpendicular to the median plane, thereby dividing the head in a frontal part and a rear part.

In the arrangement, the following may apply: $0°<\alpha<90°$ and $0°<\delta<90°$, $15°<\alpha<90°$ and $15°<\delta<90°$, or $40°<\alpha<90°$ and $40°<\delta<90°$.

At least one loudspeaker may be arranged below a horizontal plane on a frontal part of the frame such that it provides sound to the ear of a user from a lower frontal direction, and the main direction of sound propagation of the at least one loudspeaker may be directed towards the horizontal plane, wherein the horizontal plane crosses through an ear canal of the user and is perpendicular to the median plane and the frontal plane, thereby dividing the head in an upper part and a lower part.

One loudspeaker of the arrangement may be arranged below the horizontal plane on the frontal part of the frame, wherein the main direction of sound propagation of the loudspeaker is angled at a second angle with respect to the horizontal plane. The second angle may be between about 10° and about 40°. Two or more loudspeakers may be arranged below the horizontal plane on the frontal part of the frame, wherein the main direction of sound propagation of each individual loudspeaker may be angled with respect to the horizontal plane, and wherein an average angle of the respective main directions of sound propagation may be between about 10° and about 40°.

The ear cup may comprise surfaces that are oriented essentially towards the pinna and surfaces that are oriented essentially away from the pinna, wherein at least parts of the surfaces oriented essentially towards the pinna comprise a sound absorbing material, the sound absorbing material being configured to reduce the intensity of sound that is emitted by the at least one loudspeaker and reflected towards the pinna of the user.

The main directions of sound propagation of each of the at least one loudspeaker may be at an angle of >0° to any symmetry axis of the frame. The frame may comprise a plurality of sections, wherein at least one section is arranged behind the pinna such that it is shaded from direct sound emitted by a loudspeaker arranged on the frontal part of the ear cup.

The inner walls of the frame may comprise a plurality of sections, wherein the inner walls of the frame are walls that are essentially facing the open volume within the frame, and at least sections that are arranged opposite to a loudspeaker may be at least partially beveled at an angle >20° and <90° with respect to the median plane to direct reflections away from the user's head.

At least two loudspeakers of the exemplary arrangement may be arranged adjacent to each other to form an extended sound source that is configured to emit an approximately plane sound wave. The arrangement may further comprise at least two loudspeakers, and at least one of the following may apply: a first loudspeaker is arranged on the frontal part of the ear cup and a second loudspeaker is arranged on the rear part of the ear cup, wherein the first loudspeaker is arranged on or below the horizontal plane such that its main direction of sound propagation is at an angle $\sigma$ with respect to the horizontal plane, wherein $0° < \sigma < 90°$, and the second loudspeaker is arranged on or below the horizontal plane such that its main direction of sound propagation is at an angle $\omega$ with respect to the horizontal plane, wherein $0° < \sigma < 90°$, $0° < \omega < 90°$ and $\omega \neq \sigma$, and wherein the angle between the main direction of sound propagation of the first loudspeaker and the main direction of sound propagation of the second loudspeaker is >90°; and the at least two loudspeakers are arranged in at least a frontal loudspeaker group and a rear loudspeaker group, wherein each loudspeaker group comprises at least two loudspeakers that are arranged adjacent to each other, wherein at least one loudspeaker of the frontal loudspeaker group is arranged on or below the horizontal plane such that its main direction of sound propagation is at an angle $\sigma$ with respect to the horizontal plane, wherein $0° < \sigma < 90°$, and wherein the angle between the main direction of sound propagation of the lowest frontal loudspeaker and the main direction of sound propagation of the lowest rear loudspeaker is >90°.

The exemplary arrangement may further comprise at least one first feedback loop configured to provide distortion compensation, wherein the feedback loop comprises at least one first feedback microphone that is arranged in close proximity to at least one of the loudspeakers. The exemplary arrangement may further comprise at least one second feedback loop configured to provide active noise cancellation, wherein the second feedback loop comprises at least one second feedback microphone that is arranged in close proximity to the entry of the ear canal of the user.

The exemplary arrangement may further comprise a cover configured to be separably mounted to the ear cup and to form a closed headphone with the frame when mounted to the ear-cup, wherein the closed headphone defines an essentially closed volume around the ear of the user. The exemplary arrangement may further comprise at least one third feedback loop configured to provide active noise cancellation and to support awareness modes for acoustical events in the environment of the user, wherein the third feedback loop comprises at least one third microphone that is arranged outside of the closed volume on the cover or the frame of the ear cup.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices, such as the signal processing components and sound sources discussed above. The methods may be performed by executing stored instructions with one or more logic devices (e.g., processors) in combination with one or more additional hardware elements, such as storage devices, memory, hardware network interfaces/antennas, switches, actuators, clock circuits, etc. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

While various embodiments have been described, it will be apparent to those of ordinary skill in the art that many more embodiments and implementations are possible within the scope of the disclosure. Accordingly, the disclosure is not to be restricted except in light of the attached claims and their equivalents.

The invention claimed is:

1. A headphone arrangement that is configured to induce natural directional pinna cues, the arrangement comprising:

at least one ear cup comprising a frame that is configured to be arranged to at least partly encircle an ear of a user, thereby defining an open volume around the ear of the user, wherein the frame is at least partially hollow, thereby providing at least one cavity on its inside that is separated from an outside by at least one wall of the frame;

at least one loudspeaker arranged within a wall of at least one of a frontal part, a rear part, an upper part, and a lower part of the frame of the ear cup, wherein the at least one loudspeaker comprises a membrane and wherein a first side of the membrane faces a cavity inside the frame and a second side of the membrane faces the outside and wherein, when the at least one ear cup is arranged to encircle the ear of the user, at least one of the at least one loudspeaker is arranged at a first angle (α, δ) with respect to a median plane such that at least one of:

its main direction of sound propagation is directed away from the median plane; and the second side of the membrane is directed away from the median plane; wherein the median plane crosses a user's head midway between the user's ears, thereby virtually dividing the head into an essentially mirror-symmetrical left half side and right half side, a horizontal plane virtually divides the frame of the ear cup into an upper and a lower part, a frontal plane virtually divides the frame of the ear cup into a frontal part and a rear part, the frontal plane is perpendicular to the horizontal plane, the frontal plane and the horizontal plane intersect along a first axis (x), and the first axis (x) is perpendicular to the median plane and runs through a concha of the user when the at least one ear cup is arranged to encircle the ear of the user.

2. The headphone arrangement of claim 1, wherein $\alpha<90°$ and $\delta<90°$, $\alpha<75°$ and $\delta<75°$, or $<\alpha<50°$ and $\delta<50°$.

3. The headphone arrangement of claim 1, wherein at least one of:

an acoustic center of the at least one loudspeaker;

a geometric center of the at least one loudspeaker; and a geometric center of the at least one loudspeaker membrane is arranged on a lower frontal part of the frame below the horizontal plane and in front of the frontal plane such that it provides sound to the ear of the user from a lower frontal direction when the at least one ear cup is arranged to encircle the ear of the user, wherein the first axis (x) is arranged with respect to the frame of the ear cup such that it runs through an area within the median plane spanned by a virtual perpendicular projection of an inner contour outline of the frame onto the median plane, and the first axis (x) intersects a point on the median plane that is at least one of:

equally distant from two intersections of the frontal plane with the virtually projected inner contour outline on the median plane and equally distant from two intersections of the horizontal plane with the virtually projected inner contour outline on the median plane;

a geometric center of the area spanned by the virtually projected inner contour outline on the median plane;

equally distant from two intersections of the horizontal plane with the virtually projected inner contour outline on the median plane or vertically extrapolated lines thereof and at a first distance from a highest point of the virtually projected inner contour outline; and part of an area on the median plane that comprises a virtual perpendicular projection of the concha of the ear of the user onto the median plane.

4. The headphone arrangement of claim 1, wherein at least one of the at least one loudspeaker is arranged on a lower frontal part of the frame such that a representation of a perceptual relevant direction of sound propagation for the at least one loudspeaker is angled at a second angle (σ) with respect to the horizontal plane, wherein the second angle (σ) is between 10° and 40°, and the representation of the perceptual relevant direction of sound propagation is a perpendicular projection onto the median plane of the direction of sound propagation from an acoustic center of the at least one loudspeaker or a geometric center of the loudspeaker membrane towards a point on the first axis (x) when the at least one ear cup is arranged to encircle the ear of the user.

5. The headphone arrangement of claim 1, wherein two or more loudspeakers are arranged on the frontal part of the frame;

a representation of a perceptual relevant direction of sound propagation for each of the at least two loudspeakers is angled at a second angle (σ) with respect to the horizontal plane; and an average of the second angles (σ) of the individual loudspeakers is between 10° and 40° below the horizontal plane, wherein the representation of the perceptual relevant direction of sound propagation for each of the two loudspeakers is a perpendicular projection onto the median plane of the direction of sound propagation from an acoustic center of the at least one loudspeaker or a geometric center of the loudspeaker membrane towards a point on the first axis (x).

6. The headphone arrangement of claim 1, wherein inner walls of the frame comprise a plurality of inner wall surface sections, wherein the inner wall surface sections comprise all wall surfaces of the frame which adjoin the open volume about the ear of the user; and more than 30%, more than 50%, or more than 70% of the inner wall surface sections are beveled at an angle of <90°, <75°, or <50° with respect to the median plane, or face away from the first axis (x).

7. The headphone arrangement of claim 1, wherein inner walls of the frame comprise a plurality of inner wall surface sections, wherein the inner wall surface sections comprises all wall surfaces of the frame which adjoin the open volume around the ear of the user;

part of the inner wall surface sections are oriented towards a pinna of the user when the ear cup is arranged to encircle the ear of the user, while other wall surface sections are oriented away from the pinna; and at least parts of the inner wall surface sections oriented essentially towards the pinna comprise a sound absorbing material, the sound absorbing material being configured to reduce an intensity of sound reflected by the inner wall surface sections towards the pinna of the user.

8. The headphone arrangement of claim 1, wherein a representation of a perceptual relevant direction of sound propagation for each of the at least one loudspeaker is at an angle of >10° to any symmetry axis of a projection of an inner contour outline of the ear cup onto the median plane; and the representation of the perceptional relevant direction of sound propagation for each respective loudspeaker is a perpendicular projection onto the median plane of the direction of sound propagation from an acoustic center of the at least one loudspeaker or a geometric center of the loudspeaker membrane towards a point on the first axis (x).

9. The headphone arrangement of claim 1, wherein at least one extended sound source is arranged within the frame of the ear cup, wherein the extended sound source has an extension of at least 25 mm along an axis parallel to the median plane; and the extended sound source comprises at least one of:

at least two loudspeakers that are arranged adjacent to each other to form an extended sound source that matches a dimension of a pinna or the concha of the user parallel to the median plane; and a single loudspeaker that matches a dimension of the pinna or the concha of the user parallel to the median plane.

10. The headphone arrangement of claim 1, wherein the arrangement comprises at least two loudspeakers and wherein:

a first loudspeaker is arranged on the frontal part of the ear cup in front of the frontal plane and a second loudspeaker is arranged on the rear part of the ear cup behind the frontal plane, the first loudspeaker is arranged below the horizontal plane such that a representation of a perceptual relevant direction of sound propagation is at an angle $\sigma$ with respect to the horizontal plane, wherein $0° < \sigma < 90°$;

the second loudspeaker is arranged on or below the horizontal plane such that a representation of its perceptual relevant direction of sound propagation is at an angle $\omega$ with respect to the horizontal plane, wherein $0° < \omega < 90°$ and $\omega \neq \sigma$;

an angle between the representation of the perceptual relevant direction of sound propagation of the first loudspeaker and the representation of the perceptual relevant direction of sound propagation of the second loudspeaker is >90°; and a representation of the perceptual relevant direction of sound propagation for each respective loudspeaker is a perpendicular projection onto the median plane of the direction of sound propagation from an acoustic center of the at least one loudspeaker or a geometric center of the loudspeaker membrane towards a point on the first axis (x).

11. The headphone arrangement of claim 1, wherein the arrangement comprises at least three loudspeakers, and wherein at least two loudspeakers are arranged in at least one of a frontal loudspeaker group and a rear loudspeaker group, wherein each loudspeaker group comprises at least two loudspeakers that are arranged adjacent to each other;

a representation of an average perceptual relevant direction of sound propagation for at least a first loudspeaker group is angled at an angle with respect to the horizontal plane, and the representation of the average perceptual relevant direction of sound propagation of at least the first loudspeaker group is essentially opposing a representation of an average perceptual relevant direction of sound propagation of at least one second loudspeaker group or a representation of the perceptual relevant direction of sound propagation of at least one additional loudspeaker; and a representation of perceptual relevant direction of sound propagation for each respective loudspeaker is a perpendicular projection onto the median plane of the direction of sound propagation from an acoustic center of the at least one loudspeaker or a geometric center of the loudspeaker membrane towards a point on the first axis (x).

12. The headphone arrangement of claim 1, further comprising at least one first feedback loop configured to provide distortion compensation, wherein the feedback loop comprises at least one loudspeaker and at least one first feedback microphone that is arranged in close proximity to at least one of the loudspeakers.

13. The headphone arrangement of claim 1, further comprising at least one second feedback loop configured to provide active noise cancellation as well as distortion compensation for at least one loudspeaker, wherein the second feedback loop comprises at least one loudspeaker and at least one second feedback microphone that is arranged adjacent to an entry of an ear canal of the user.

14. The headphone arrangement of claim 1, further comprising:

means configured to attach a cover to the ear cup in order to close a lateral opening of the ear cup; or means configured to attach the cover to the ear cup in order to close the lateral openings of the ear cup and means configured to detect whether the cover is attached to the ear cup.

15. The headphone arrangement of claim 14, further comprising at least one first feed forward path when the cover is attached to the ear cup, wherein the first feed forward path is configured to at least one of:

provide active noise cancellation for acoustic noise originating from outside the ear cup; and provide a controlled path into the ear cup for acoustical events in an environment of the user;

wherein the first feed forward path comprises at least one loudspeaker and at least one third microphone that is arranged outside of the open volume around the ear of the user on the cover or on the frame of the ear cup.

* * * * *